US010800496B2

(12) United States Patent
Kinomoto

(10) Patent No.: US 10,800,496 B2
(45) Date of Patent: Oct. 13, 2020

(54) WATER JET PROPULSION BOAT

(71) Applicant: YAMAHA HATSUDOKI KABUSHIKI KAISHA, Iwata-shi, Shizuoka (JP)

(72) Inventor: Naoki Kinomoto, Shizuoka (JP)

(73) Assignee: YAMAHA HATSUDOKI KABUSHIKI KAISHA, Iwata-Shi, Shizuoka (JP)

( * ) Notice: Subject to any disclaimer, the term of this patent is extended or adjusted under 35 U.S.C. 154(b) by 0 days.

(21) Appl. No.: 16/380,588

(22) Filed: Apr. 10, 2019

(65) Prior Publication Data

US 2020/0047859 A1 Feb. 13, 2020

(30) Foreign Application Priority Data

Aug. 8, 2018 (JP) ..... 2018-149611

(51) Int. Cl.
*B63H 11/11* (2006.01)
*B63B 34/10* (2020.01)
(Continued)

(52) U.S. Cl.
CPC ..... *B63B 34/10* (2020.02); *B63H 11/11* (2013.01); *B63H 21/21* (2013.01); *B63H 2011/081* (2013.01); *F02D 11/02* (2013.01)

(58) Field of Classification Search
CPC ... B63B 35/73; B63B 2035/731; B63B 35/81; B63B 2035/81; B63H 11/10; B63H 11/101; B63H 11/107; B63H 11/11; B63H 21/21
(Continued)

(56) References Cited

U.S. PATENT DOCUMENTS 7,195,527 B2 * 3/2007 Tani ..... B63H 21/22 440/42
7,674,144 B2 * 3/2010 Bourret ..... B63H 11/11 440/38
(Continued)

FOREIGN PATENT DOCUMENTS

JP 2010-501402 A 1/2010
JP 2012-025260 A 2/2012
(Continued)

OTHER PUBLICATIONS

SEA-DOO 2011 Operator's Guide, RXT/GTX/Wake Pro Series, English. Bombardier Recreational Products Inc. (BRP) and BRP US Inc., p. 94.

*Primary Examiner* — Daniel V Venne
(74) *Attorney, Agent, or Firm* — Rabin & Berdo, P.C.

(57) ABSTRACT

It is difficult to move forward/backward a water jet propulsion boat at very low speed through use of right and left operation elements each provided on a handle. In order to move the boat forward/backward at very low speed through a simple operation, under a state in which neutral operations have been carried out, an operation state of an engine is maintained in an idling state, and a movement position of a jet flow adjustment member including a deflector and a reverse bucket is controlled so as to adjust a difference between a "thrust generated by a forward jet flow component" and a "thrust generated by a backward jet flow component" of a jet flow divided into a forward jet flow and a backward jet flow by the jet flow adjustment member, based on an operation on a third operation element provided independently of the right and left operation elements.

20 Claims, 14 Drawing Sheets

(51) Int. Cl.
*B63H 11/08* (2006.01)
*F02D 11/02* (2006.01)
*B63H 21/21* (2006.01)

(58) Field of Classification Search
USPC ..... 114/55.5, 55.55, 55.57; 440/38, 40, 41
See application file for complete search history.

(56) References Cited

U.S. PATENT DOCUMENTS

| | | | | |
|---|---|---|---|---|
| 7,708,609 | B2 * | 5/2010 | Plante | B63H 25/48 440/1 |
| 7,775,844 | B2 * | 8/2010 | St-Pierre | B63H 11/113 440/40 |
| 7,841,915 | B2 * | 11/2010 | Bourret | B63H 11/107 440/41 |
| 8,202,136 | B2 * | 6/2012 | Dagenais | B63H 11/08 440/41 |
| 9,650,121 | B2 * | 5/2017 | Kinoshita | B63H 21/21 |
| 2015/0093946 | A1 * | 4/2015 | Kinoshita | B63H 21/21 440/1 |

FOREIGN PATENT DOCUMENTS

| | | | |
|---|---|---|---|
| JP | 2014-024534 | A | 2/2014 |
| JP | 5599480 | B2 | 10/2014 |

* cited by examiner

WATER JET PROPULSION BOAT

CROSS REFERENCE TO RELATED APPLICATION

The entire disclosure of a corresponding Japanese patent application, Serial No. JP PA 2018-149611, filed Aug. 8, 2018, is hereby incorporated by reference.

BACKGROUND OF THE INVENTION

1. Field of the Invention

The present invention relates to a water jet propulsion boat including a jet flow adjustment member capable of dividing a jet flow, which is jetted out from a jet flow generation device and directed backward of a boat body, into a jet flow for a forward movement and a jet flow for a backward movement.

2. Description of the Related Art

Hitherto, there has been known a water jet propulsion boat including a jet flow generation device (jet propulsion mechanism) and a jet flow adjustment member (for example, a reverse bucket). The jet flow generation device is driven by an engine, and is configured to generate a jet flow by jetting out the water, which is sucked from the outside of the boat body, from a jet port backward of the boat body. The jet flow adjustment member is capable of dividing the jet flow into a jet flow having a backward jet flow component directed backward of the boat body (hereinafter referred to as "forward-movement jet flow") and a jet flow having a forward jet flow component directed forward of the boat body (hereinafter referred to as "backward-movement jet flow").

One of related-art water jet propulsion boats (hereinafter referred to as "related-art boat") includes an operation element at each of a right grip portion and a left grip portion of a steering handle having a bar shape. When predetermined forward-movement operations are carried out on the operation elements, the related-art boat moves the jet flow adjustment member to a position at which the jet flow from the jet flow generation device is not substantially blocked (hereinafter referred to as "forward-movement position"). As a result, the related-art boat obtains the strong forward-movement jet flow, and uses the forward-movement jet flow as a thrust to move forward.

Meanwhile, when predetermined backward-movement operations are carried out on the operation elements, the related-art boat moves the jet flow adjustment member to a position at which the jet flow from the jet flow generation device is blocked (hereinafter referred to as "backward-movement position"), and substantially only the forward jet flow component is generated. As a result, the related-art boat obtains the backward-movement jet flow, and uses the backward-movement jet flow as a thrust to move backward.

Further, when predetermined neutral operations are carried out on the operation elements, the related-art boat moves the jet flow adjustment member to a position at which part of the jet flow from the jet flow generation device is blocked (hereinafter referred to as "neutral position"). As a result, the related-art boat can substantially balance the thrust for the forward movement through the forward-movement jet flow and the thrust for the backward movement through the backward-movement jet flow with each other to maintain a substantial boat stop state (for example, refer to Japanese Patent Application Laid-open (Kokai) No. 2014-24534).

Incidentally, under the state in which the jet flow adjustment member is at the forward-movement position, even when the operation state of the engine is maintained in the idle state, the boat body moves forward at a certain speed. Similarly, under the state in which the jet flow adjustment member is at the backward-movement position, even when the operation state of the engine is maintained in the idle state, the boat body moves backward at a certain speed. Thus, for example, in order to move the related-art boat forward or backward at very low speed in such a case as causing the related-art boat to approach a predetermined position of a pier, an operator (occupant) is required to frequently carry out the forward-movement operations, the backward-movement operations, and the neutral operations on the operation elements.

Further, even when the neutral operations are carried out on the operation elements, it is difficult to maintain the related-art boat in the boat stop state in a case where the water flows such as a river or a canal. Therefore, the operator is required to frequently operate the operation elements.

SUMMARY OF THE INVENTION

The present invention has been made in view of the above-mentioned problem. That is, one of objects of the present invention is to provide a water jet propulsion boat capable of moving forward and backward at very low speed through a simple operation.

In order to achieve the above-mentioned object, a water jet propulsion boat according to one embodiment of the present invention (hereinafter also referred to as "present boat") includes a boat body, an engine, a jet flow generation device, a jet flow adjustment member, a first operation element, a second operation element, a third operation element, and a control device.

The engine is mounted to the boat body. The jet flow generation device is to be driven by the engine, and is configured to jet out water from a jet port backward of the boat body to generate a jet flow, and to generate the jet flow even when the engine is in an idling state. Thus, as the rotation speed of the engine increases, a flow rate of the jet flow jetted out from the jet port of the jet flow generation device increases.

The jet flow adjustment member is, for example, a "deflector and/or reverse bucket" described later, and is provided so as to be movable with respect to the boat body. The jet flow adjustment member is configured to divide the jet flow from the jet port into a "forward-movement jet flow having a backward jet flow component directed backward of the boat body" and a "backward-movement jet flow having a forward jet flow component directed forward of the boat body". The jet flow adjustment member is configured to adjust a difference between a thrust generated by the forward jet flow component and a thrust generated by the backward jet flow component in accordance with a movement position of the jet flow adjustment member. For example, when a magnitude of the thrust generated by the backward jet flow component is larger than a magnitude of the thrust generated by the forward jet flow component, the present boat can move forward. In contrast, when the magnitude of the thrust generated by the backward jet flow component is smaller than the magnitude of the thrust generated by the forward jet flow component, the present boat can move backward.

The first operation element is provided in a right grip portion of a steering handle provided on the boat body, and has an operation amount that is changeable. The second operation element is provided in a left grip portion of the steering handle provided on the boat body, and has an operation amount that is changeable.

When a first mode is selected, the control device controls an amount of the jet flow and controls the movement position of the jet flow adjustment member based on the operation amount of at least one of the first operation element or the second operation element.

In addition, when a second mode is selected, the control device maintains an operation state of the engine in an idling state, and controls the movement position of the jet flow adjustment member in accordance with an operation on the third operation element.

With the present boat configured as described above, in the first mode, the flow rate of the jet flow from the jet port can be changed based on the operation amount of any one of the first operation element and the second operation element. Thus, the operator can greatly change the forward moving speed or the backward moving speed of the present boat in the first mode. Meanwhile, in the second mode, the flow rate of the jet flow jetted out from the jet port is maintained to a predetermined small flow rate (namely, an idling flow rate).

Further, with the present boat, in the second mode, the difference between the thrust generated by the forward jet flow component and the thrust generated by the backward jet flow component can be adjusted by changing the movement position of the jet flow adjustment member in accordance with the operation on the third operation element provided independently of the first operation element and the second operation element. At this time, the operation state of the engine is maintained in the idling state, and thus a magnitude of the difference between the thrust generated by the backward jet flow component and the thrust generated by the forward jet flow component is slightly changed by the operation on the third operation element.

As a result, when the thrust generated by the backward jet flow component becomes larger than the thrust generated by the forward jet flow component, the present boat moves forward at very low speed. In contrast, when the thrust generated by the forward jet flow component becomes larger than the thrust generated by the backward jet flow component, the present boat moves backward at very low speed. Thus, once the operator selects the second mode, the operator can move the present boat forward or backward at very low speed only by operating the third operation element.

As the third operation element, for example, a push button switch or a dial switch may be provided adjacent to the right grip portion or the left grip portion. As a result, in the second mode, the operator can slightly change the difference between the thrust generated by the backward jet flow component and the thrust generated by the forward jet flow component by operating the third operation element.

With the water jet propulsion boat according to one embodiment of the present invention, the water jet propulsion boat can be moved forward/backward at very low speed by operating the third operation element.

BRIEF DESCRIPTION OF THE DRAWINGS

FIG. 2A, FIG. 2B, and FIG. 2C are side views for illustrating turn positions of a deflector of the water jet propulsion boat illustrated in FIG. 1, in which FIG. 2A is a side view for illustrating a neutral position, FIG. 2B is a side view for illustrating a downward position, and FIG. 2C is a side view for illustrating an upward position.

FIG. 3A and FIG. 3B are views for illustrating an arrangement of a jet flow generation device and a jet flow adjustment member in a state in which a reverse bucket of the water jet propulsion boat illustrated in FIG. 1 is at a backward-movement position, in which FIG. 3A is a side view, and FIG. 3B is a top view.

FIG. 4A and FIG. 4B are views for illustrating an arrangement of the jet flow generation device and the jet flow adjustment member in a state in which the reverse bucket of the water jet propulsion boat illustrated in FIG. 1 is at a forward-movement position, in which FIG. 4A is a side view, and FIG. 4B is a top view.

FIG. 5A and FIG. 5B are views for illustrating an arrangement of the jet flow generation device and the jet flow adjustment member in a state in which the reverse bucket of the water jet propulsion boat illustrated in FIG. 1 is at a neutral position, in which FIG. 5A is a side view, and FIG. 5B is a top view.

FIG. 9A and FIG. 9B are side views for illustrating turn positions of the reverse bucket of the water jet propulsion boat illustrated in FIG. 1, in which FIG. 9A is a side view for illustrating a very low-speed forward-movement position, and FIG. 9B is a very low-speed backward-movement position.

FIG. 12A, FIG. 12B, and FIG. 12C are side views for illustrating movement positions of the deflector of the water jet propulsion boat illustrated in FIG. 1, in which FIG. 12A is a side view for illustrating a neutral position, FIG. 12B is a side view for illustrating a very low-speed forward-movement position, and FIG. 12C is a side view for illustrating a very low-speed backward-movement position.

DESCRIPTION OF THE EMBODIMENTS

First Embodiment (Configuration)

Figure 1:
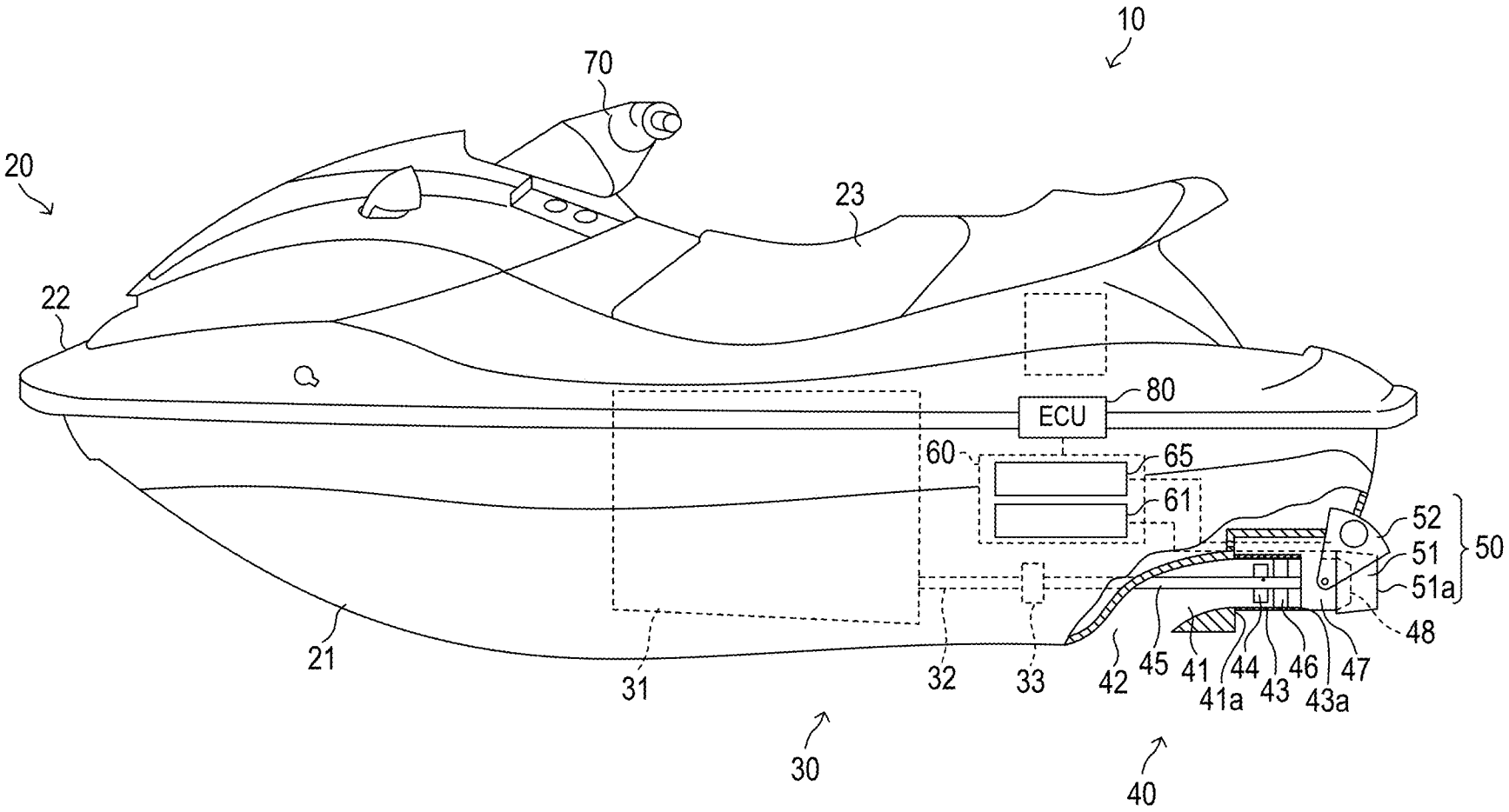
FIG. 1 is a schematic configuration view of a water jet propulsion boat according to an embodiment of the present invention.

As illustrated in FIG. 1, a water jet propulsion boat (hereinafter also referred to as "first jet propulsion boat") 10 according to a first embodiment includes, for example, a boat body 20, a drive device 30, a jet flow generation device 40, a jet flow adjustment member 50, an actuator 60, an operation part 70, and a control device (ECU) 80.

The boat body 20 includes a hull 21, a deck 22, and a seat 23. The hull 21 forms a boat bottom. The deck 22 is arranged above the hull 21. The seat 23 is arranged at a center of the deck 22 in a right-and-left direction, and is configured to allow an operator (occupant) (not shown) to be seated thereon.

The drive device 30 includes an engine 31, a crankshaft 32, and a coupling 33. The drive device 30 is arranged in a space partitioned between the hull 21 and the deck 22. The engine 31 is a multi-cylinder internal combustion engine of a spark ignition type. The engine 31 is arranged below the seat 23. The crankshaft 32 is a rotational shaft configured to output a drive torque generated by the engine 31. The crankshaft 32 is arranged at the center of the hull 21 in the right-and-left direction so as to extend backward of the boat body 20. The coupling 33 is configured to couple and fix the crankshaft 32 and an impeller shaft 45, which is to be described later, to each other.

The jet flow generation device 40 includes a flow passage 41, a water suction port 42, an impeller housing 43, an impeller 44, the impeller shaft 45, a stationary blade 46, a nozzle 47, and a jet port 48. The flow passage 41 is formed in a rear portion of the hull 21 and at a center portion of the hull 21 in the right-and-left direction. One end of the flow passage 41 opens downward of the hull 21 as the water suction port 42 configured to suck water. Another end 41*a* of the flow passage 41 opens backward of the hull 21.

The impeller housing 43 is provided so as protrude backward of the hull 21 from the another end 41*a* of the flow passage 41. The impeller 44 is coupled to the impeller shaft 45, and is configured to rotate integrally with the impeller shaft 45 about a center axis of the impeller shaft 45 in the impeller housing 43. The stationary blade 46 is arranged and fixed on a back side of the impeller 44 in the impeller housing 43. The nozzle 47 is a cylindrical member, and is arranged and fixed at a back end 43*a* of the impeller housing 43. A back end of the nozzle 47 opens as the jet port 48 configured to jet out the water.

With this configuration, when a driving force generated by the engine 31 rotates the impeller 44, the water from the outside (lower side of the hull 21) of the boat body 20 is sucked into the flow passage 41 through the water suction port 42. The water sucked into the flow passage 41 is supplied from the impeller 44 to the stationary blade 46. The water supplied by the impeller 44 is straightened after passing through the stationary blade 46. The straightened water passes through the nozzle 47, and is jetted out from the jet port 48 backward of the boat body 20. In such a manner, the jet flow generation device 40 is capable of generating a jet flow directed backward of the boat body 20. With this configuration, when the rotation speed of the engine 31 is set to be high, a flow rate of the jet flow jetted out from the jet flow generation device 40 increases. Thus, the amount of the jet flow jetted out from the jet flow generation device 40 is adjusted by changing the operation state (rotation speed) of the engine 31. Even when the engine 31 is in the idling state, the flow rate exists. The flow rate of the jet flow in this case is also referred to as "idling flow rate".

The jet flow adjustment member 50 includes a deflector 51 and a reverse bucket 52. The actuator 60 includes a deflector moving mechanism 61 and a reverse bucket moving mechanism 65.

Figure 2A:
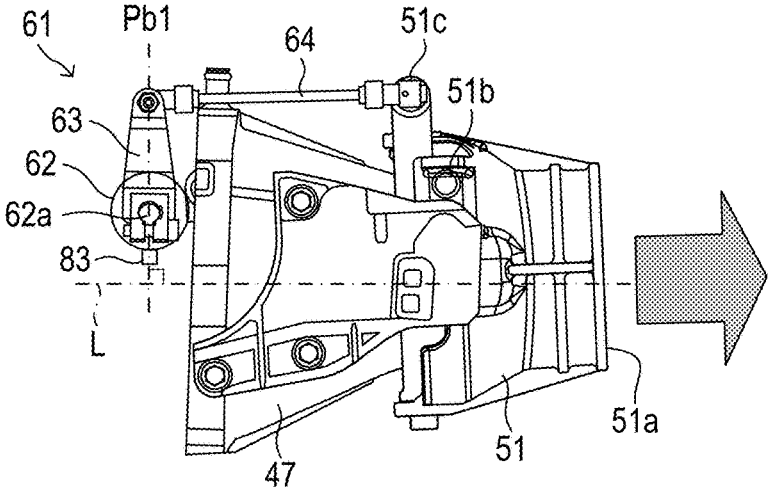
Figure 2B:
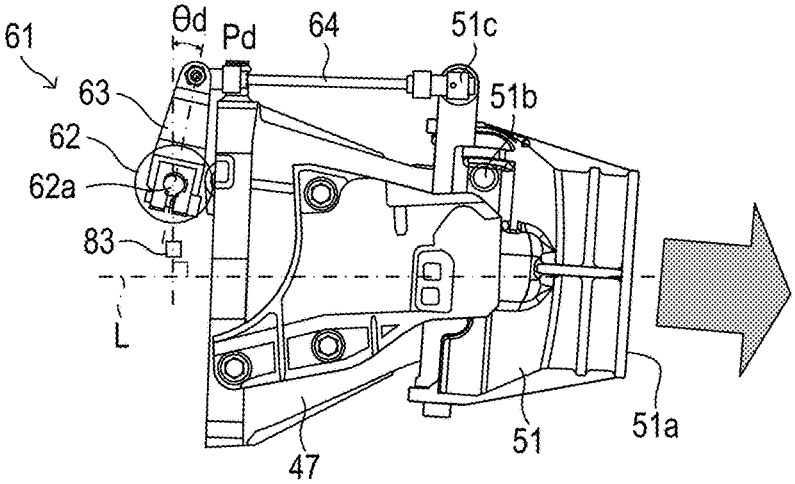
Figure 2C:
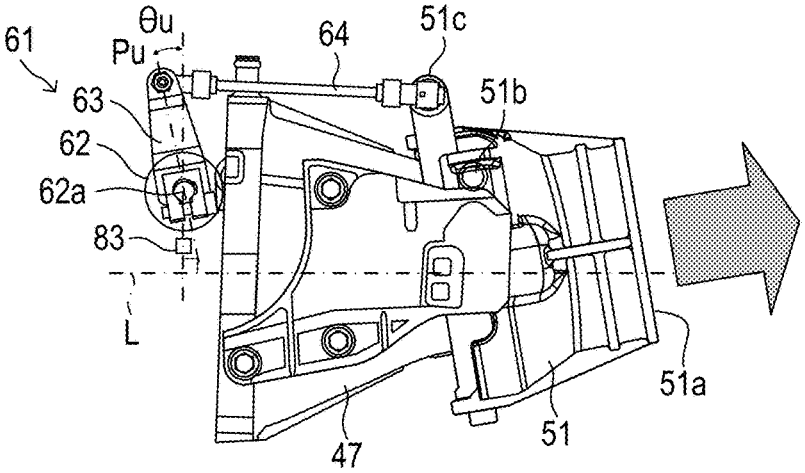

As illustrated in FIG. 2A, the deflector 51 is a member having a substantially cylindrical shape (frustoconical shape), which is arranged on a back side of the nozzle 47. The deflector 51 is formed so that a diameter thereof decreases as extending in a backward-movement direction (rightward on the drawing sheet) of the boat body 20. The deflector 51 is supported by the nozzle 47 (thus, the boat body 20) so as to be turnable about a vertical axis (perpendicular axis) (in the right-and-left direction of the boat body 20) and be turnable about a horizontal axis (in the up-and-down direction of the boat body 20). The deflector 51 covers the jet port 48 of the nozzle 47 (see FIG. 1). Thus, the jet flow jetted out from the jet port 48 passes through the deflector 51, and is jetted out from a discharge port 51*a*. In FIG. 2A to FIG. 2C, the reverse bucket 52 is not omitted for the sake of convenience.

A coupling part 51*b* is provided at a side portion of the deflector 51. The deflector 51 turns right and left through an operation on an operation cable (not shown) coupled to the coupling part 51*b*.

A coupling part 51*c* is provided at an upper portion of the deflector 51. The deflector 51 turns about the horizontal axis through movement of an arm, which is coupled to the coupling part 51*c*, by the deflector moving mechanism 61.

The deflector moving mechanism 61 includes a trim actuator 62, a trim arm 63, and a link 64. The trim actuator 62 is a well-known servomotor. The trim actuator 62 includes an output shaft 62*a*. The trim actuator 62 is arranged so that a center axis of the output shaft 62*a* is parallel with the right-and-left direction of the boat body 20. The trim arm 63 is an arm extending from the output shaft 62*a* upward in the vertical direction. The trim arm 63 is fixed at its lower end to the output shaft 62*a* so as to be rotatable integrally with the output shaft 62*a*. The link 64 couples the trim arm 63 and the deflector 51 to each other.

As illustrated in FIG. 2A, when a lengthwise direction of the trim arm 63 is perpendicular to a horizontal plane L of the boat body 20 (that is, when the trim arm 63 is at a reference position Pb1), a direction of a center axis of the deflector 51 is set to be substantially parallel with the horizontal plane L. On this occasion, the jet flow jetted out from the jet port 48 of the nozzle 47 (hereinafter sometimes simply referred to as "nozzle jet flow") passes through the deflector 51, and is then jetted out from the discharge port 51*a* backward of the boat body 20 substantially in parallel with the horizontal plane L. The turn position of the deflector 51 in this case is referred to as "neutral position".

As illustrated in FIG. 2B, when the trim arm 63 is at a position Pd after being rotated clockwise (rightward) from the reference position Pb1 by a predetermined angle θd in side view, the direction of the center axis of the deflector 51 is set to be downward with respect to the horizontal plane L. On this occasion, the nozzle jet flow passes through the deflector 51, and is then jetted out backward of the boat body 20 from the discharge port 51*a* obliquely downward with respect to the horizontal plane L. The turn position of the deflector 51 in this case is referred to as "downward position".

As illustrated in FIG. 2C, when the trim arm 63 is at a position Pu after being rotated counterclockwise (leftward) from the reference position Pb1 by a predetermined angle θu in side view, the direction of the center axis of the deflector 51 is set to be upward with respect to the horizontal plane L. On this occasion, the nozzle jet flow passes through the deflector 51, and is then jetted out backward of the boat body 20 from the discharge port 51*a* obliquely upward with respect to the horizontal plane L. The turn position of the deflector 51 in this case is referred to as "upward position". Further, the deflector moving mechanism 61 is capable of changing the rotation position of the trim arm 63 to any position between the position Pu and the position Pd (including the position Pu and the position Pd).

With this configuration, the deflector 51 is arranged so as to be turnable about the vertical axis and the horizontal axis on the back side of the jet port 48. Thus, the deflector 51 is capable of changing orientations of the jet flow, which is jetted out from the jet port 48 backward of the boat body 20, in the right-and-left direction and in the up-and-down direction in accordance with the turn position of the deflector 51.

Figure 3A:
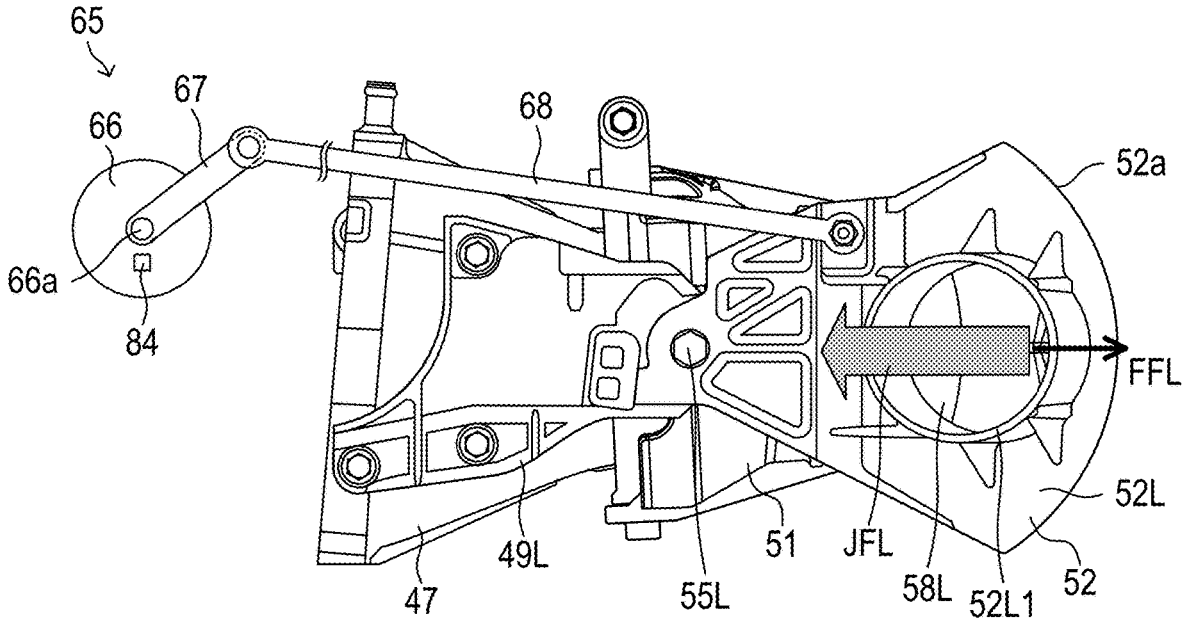
Figure 3B:
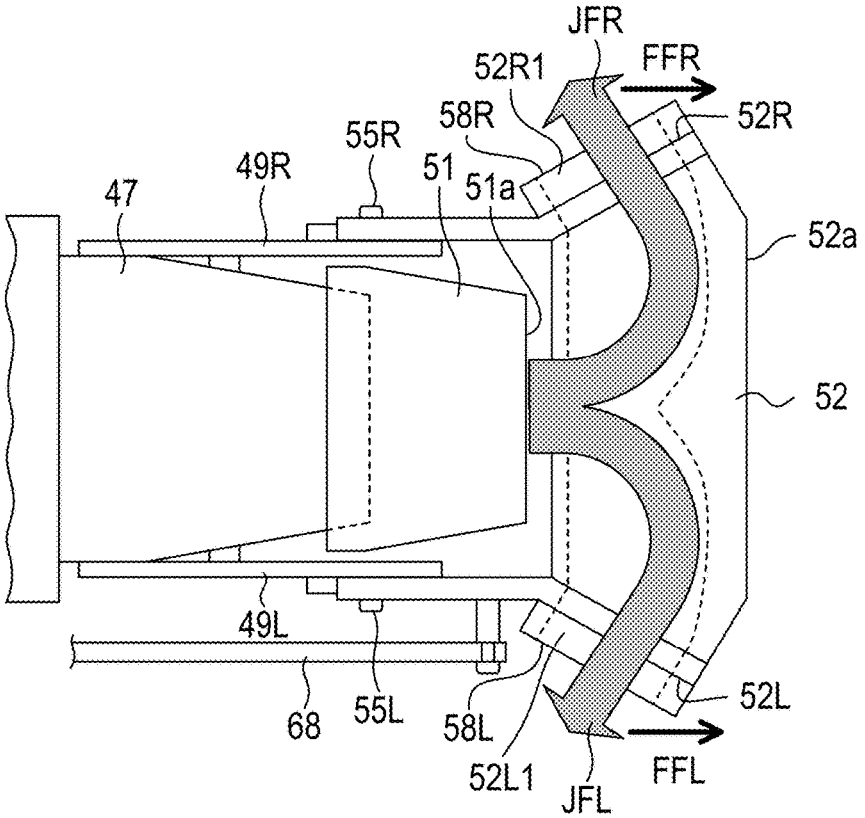

As illustrated in FIG. 3A and FIG. 3B, the reverse bucket 52 includes a rear wall 52*a*, a right side surface 52R, and a left side surface 52L. The rear wall 52*a* serves as an opening/closing part configured to open and close the discharge port 51*a* of the deflector 51. The right side surface 52R and the left side surface 52L face each other in the right-and-left direction of the boat body 20. As illustrated in FIG. 3A, the left side surface 52L (also the right side surface 52R) widens in the up-and-down direction as extending backward of the boat body 20 (rightward on the drawing sheet). That is, each of the right side surface 52R and the left side surface 52L has a substantially fan shape. Meanwhile, as illustrated in FIG. 3B, the right side surface 52R and the left side surface 52L are separated away from each other in the right-and-left direction of the boat body 20 as extending in the backward-movement direction of the boat body 20.

A jetting passage part 52R1 having a substantially cylindrical shape with a center axis thereof directed obliquely right forward of the boat body 20 is provided on the right side surface 52R. A right opening 58R is formed at an end of the jetting passage part 52R1. A jetting passage part 52L1 having a substantially cylindrical shape with a center axis thereof directed obliquely left forward of the boat body 20 is provided on the left side surface 52L. A left opening 58L is formed at an end of the jetting passage part 52L1. The right opening 58R and the left opening 58L are formed so as to be symmetrical in the right-and-left direction over a center axis extending in a front-and-back direction of the boat body 20.

The reverse bucket 52 is axially supported with bolts 55R and 55L on a pair of right and left brackets 49R and 49L, respectively. The pair of right and left brackets 49R and 49L are fixed to both of the right and left sides of the nozzle 47. The reverse bucket 52 is turnable between the back side and the top side of the deflector 51 about a horizontal axis passing through centers of the bolts 55R and 55L.

As illustrated in FIG. 3A, the reverse bucket 52 is moved (turned) by the reverse bucket moving mechanism 65 between a backward-movement position described later and a forward-movement position described later. The reverse bucket moving mechanism 65 includes a shift actuator 66, a shift arm 67, and a link 68. The shift actuator 66 is a well-known servomotor. The shift actuator 66 includes an output shaft 66*a*. The shift actuator 66 is arranged so that a center axis of the output shaft 66*a* is parallel with the right-and-left direction of the boat body 20. The shift arm 67 is fixed to the output shaft 66*a* of the shift actuator 66 so as to be perpendicular to the center axis of the output shaft 66*a*, and is fixed to the output shaft 66*a* so as to be rotatable integrally with the output shaft 66*a*. The link 68 couples the shift arm 67 and the reverse bucket 52 to each other. That is, the link 68 has one end coupled to the shift arm 67 so as to be rotatable relative to the shift arm 67, and has another end coupled to the reverse bucket 52 so as to be rotatable relative to the reverse bucket 52. With such a configuration, the reverse bucket moving mechanism 65 is capable of turning the reverse bucket 52 to a predetermined position through the rotation of the shift actuator 66, and maintaining the turn position of the reverse bucket 52.

When the reverse bucket 52 is at the backward-movement position, as illustrated in FIG. 3A and FIG. 3B, an entire region of the discharge port 51*a* is covered with the rear wall 52*a* of the reverse bucket 52 in rear view. As illustrated in FIG. 3B, when the jet flow jetted out from the discharge port 51*a* collides with an inner side of the rear wall 52*a*, the jet flow changes its direction, and is jetted out from the left opening 58L and the right opening 58R, respectively, outward in the right and left directions and forward of the boat body 20 (obliquely forward of the boat body 20). The jet flow jetted out from the right opening 58R is hereinafter referred to as "right jet flow JFR". The jet flow jetted out from the left opening 58L is hereinafter referred to as "left jet flow JFL".

In this case, most of the jet flow jetted out from the discharge port 51*a* is jetted out from the right opening 58R and the left opening 58L. Each of the right jet flow JFR and the left jet flow JFL has a jet flow component directed forward of the boat body 20 (hereinafter referred to as "forward jet flow component"). A thrust generated by the forward jet flow components is a thrust for moving the boat body 20 backward (backward-movement thrust). Thus, when the reverse bucket 52 is at the backward-movement position, the first jet propulsion boat 10 can move backward. The jet flow having the forward jet flow component is hereinafter also referred to as "backward-movement jet flow JF". The backward-movement jet flow JF is a vector sum of the right jet flow JFR and the left jet flow JFL. A thrust generated by the forward jet flow component of the right jet flow JFR (backward-movement thrust) is hereinafter referred to as "thrust FFR". A thrust generated by the forward jet flow component of the left jet flow JFL (backward-movement thrust) is hereinafter referred to as "thrust FFL". When the turn position of the deflector 51 in the right-and-left direction is neutral, the forward jet flow component of the right jet flow JFR and the forward jet flow component of the left jet flow JFL are substantially equal to each other.

Figure 4A:
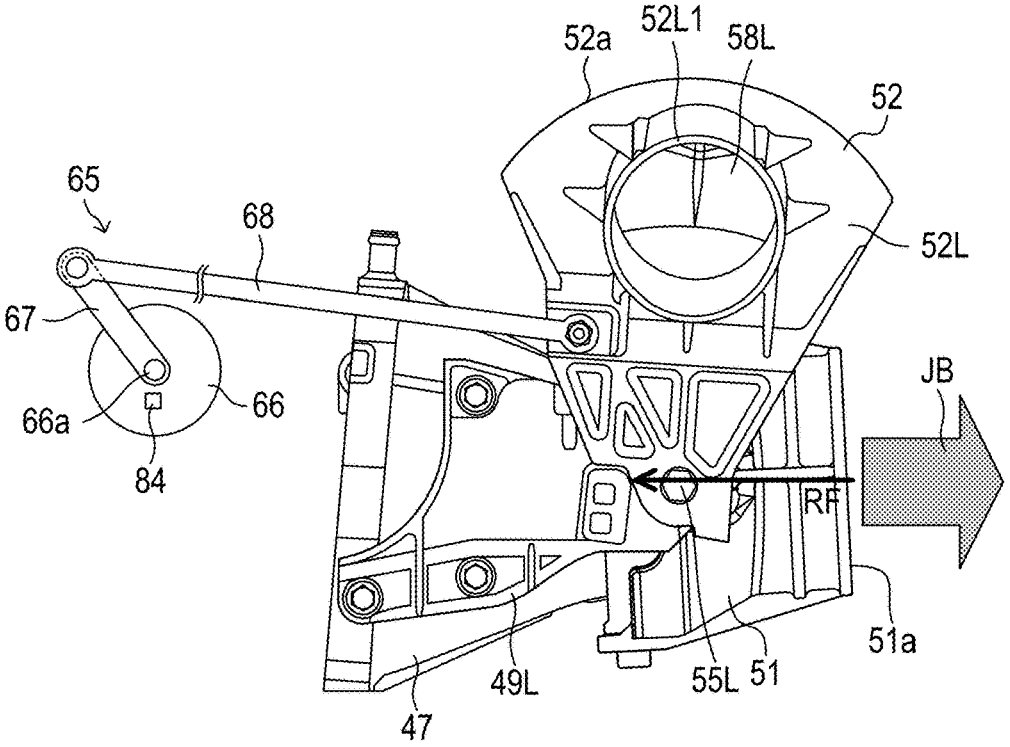
Figure 4B:
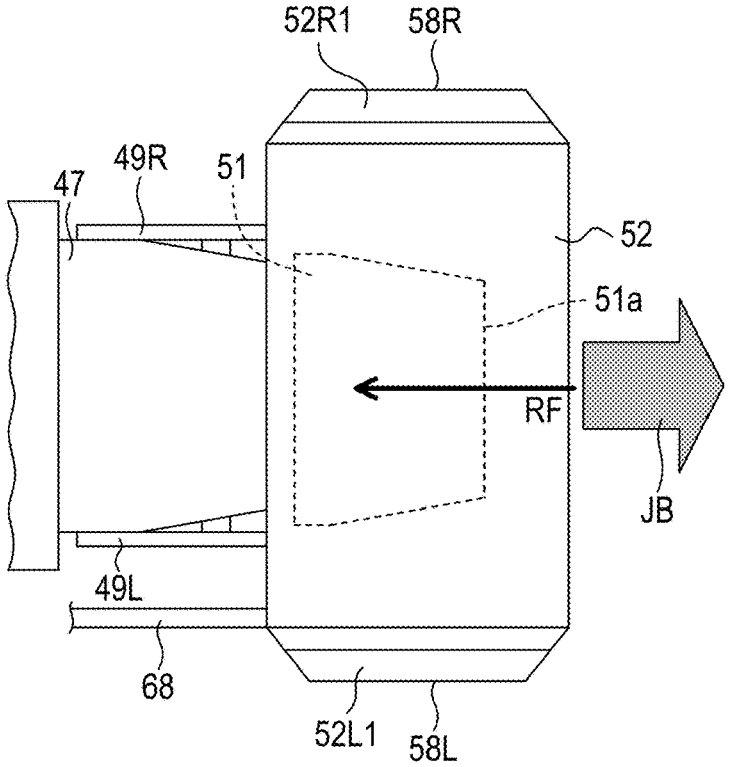

When the reverse bucket 52 is at the forward-movement position, as illustrated in FIG. 4A and FIG. 4B, the entire region of the discharge port 51*a* is not covered with the rear wall 52*a* of the reverse bucket 52 in rear view. The jet flow jetted out from the discharge port 51*a* is jetted out backward of the boat body 20 without colliding with the rear wall 52*a* of the reverse bucket 52.

That is, this jet flow has a jet flow component directed backward of the boat body 20 (hereinafter referred to as "backward jet flow component"). A thrust generated by the backward jet flow component is a thrust for moving the boat body 20 forward (forward-movement thrust). Thus, when the reverse bucket 52 is at the forward-movement position, the first jet propulsion boat 10 can move forward. The jet flow having the backward jet flow component is hereinafter also referred to as "forward-movement jet flow JB". A thrust generated by the backward jet flow component of the forward-movement jet flow JB (forward-movement thrust) is hereinafter referred to as "thrust RF".

Figure 5A:
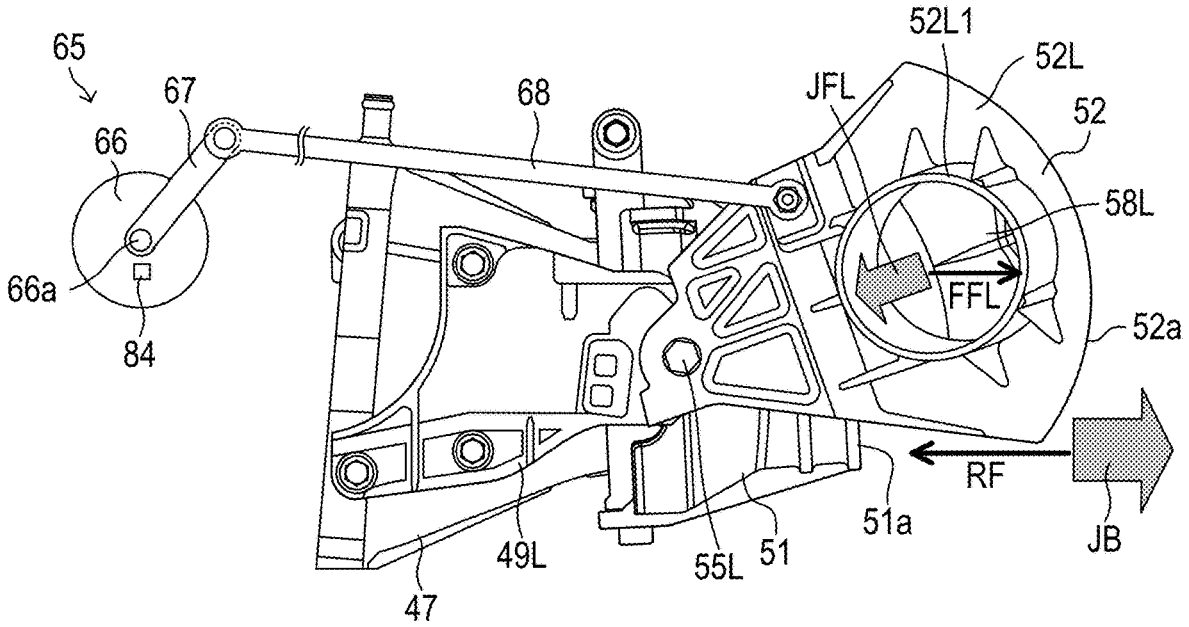
Figure 5B:
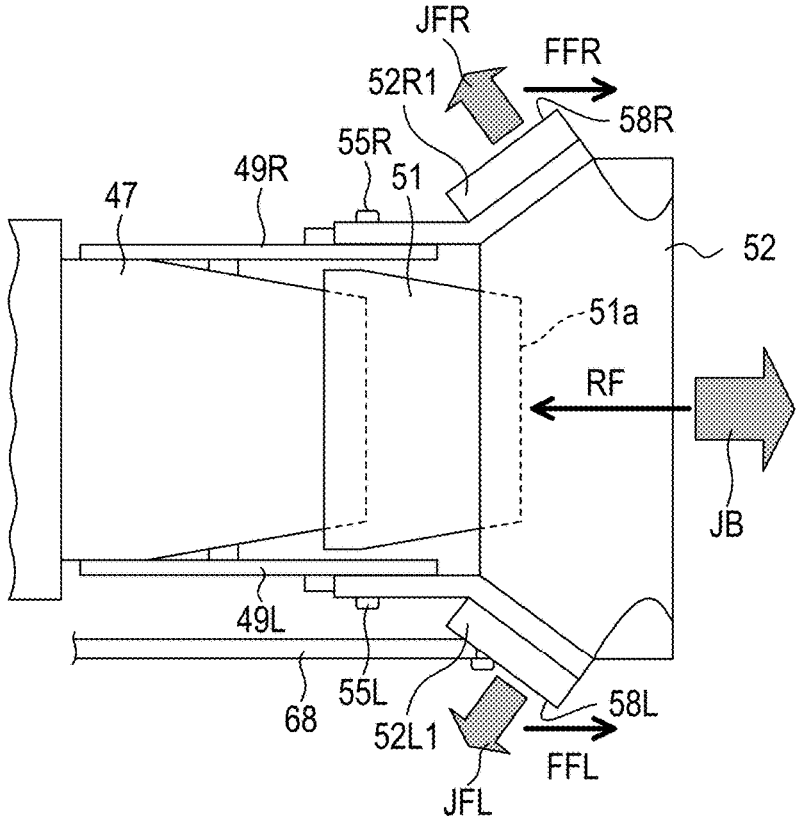

When the reverse bucket 52 is at the neutral position, as illustrated in FIG. 5A and FIG. 5B, a center portion and an upper portion of the discharge port 51*a* are covered with the rear wall 52*a* of the reverse bucket 52 in rear view, and a lower portion of the discharge port 51*a* is not covered with the rear wall 52*a* of the reverse bucket 52 in rear view. That is, the neutral position is a position between the backward-movement position and the forward-movement position.

Thus, when the reverse bucket 52 is at the neutral position, part of the jet flow jetted out from the discharge port 51*a* collides with the rear wall 52*a* of the reverse bucket 52, changes its direction, and is jetted out from the left opening 58L and the right opening 58R as the backward-movement jet flow (that is, the right jet flow JFR and the left jet flow JFL). Meanwhile, the rest of the jet flow jetted out from the discharge port 51*a* passes under the reverse bucket 52, and is jetted out backward as the forward-movement jet flow JB.

When the reverse bucket 52 is at the neutral position, a magnitude of the sum of the thrust (backward-movement thrust) generated by the forward jet flow component of the right jet flow JFR and the thrust (backward-movement thrust) generated by the forward jet flow component of the left jet flow JFL (namely, a magnitude of the thrust generated by the backward-movement jet flow JF) and a magnitude of the thrust generated by the forward-movement jet flow JB are approximately equal to each other. However, in this example, the magnitude of the thrust generated by the forward-movement jet flow JB is slightly larger than the magnitude of the thrust generated by the backward-movement jet flow JF. Thus, the boat body 20 moves forward at very low speed.

In such a manner, the reverse bucket 52 is capable of dividing the jet flow, which is jetted out from the discharge port 51*a* of the deflector 51, into the forward-movement jet flow JB and the backward-movement jet flow JF in accordance with the movement position (turn position) of the reverse bucket 52.

Figure 6:
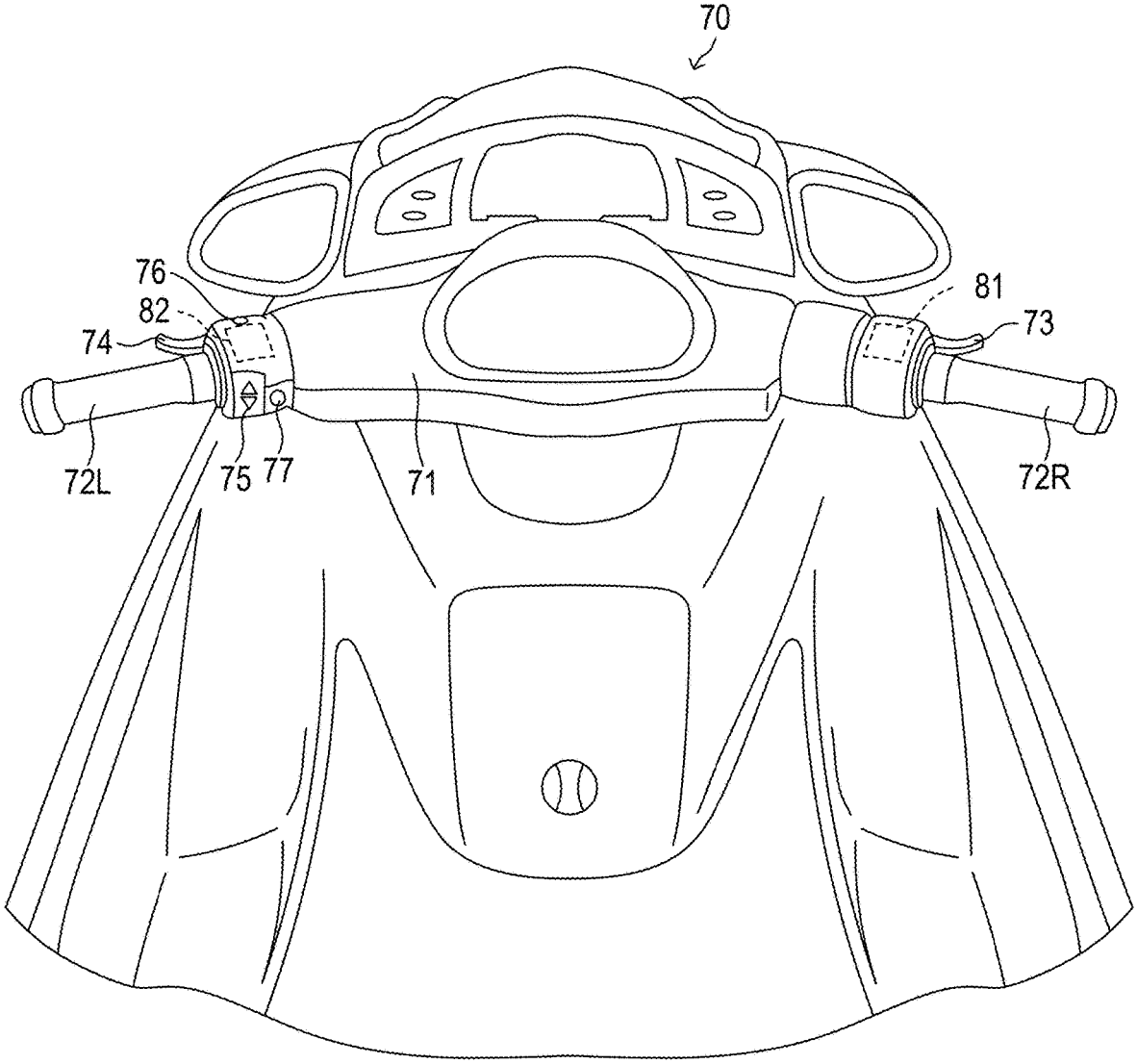
FIG. 6 is a perspective view for illustrating a configuration in a vicinity of a steering handle of the water jet propulsion boat illustrated in FIG. 1.

As illustrated in FIG. 6, the operation part 70 includes a steering handle 71, a right grip portion 72R, a left grip portion 72L, a first operation element 73, a second operation element 74, a third operation element 75, a start switch 76, and a stop switch 77.

The steering handle 71 is a handle having a bar shape and extending in the right-and-left direction of the boat body 20. The steering handle 71 is axially supported at a center part of the boat body 20 in the right-and-left direction so as to be turnable. The right grip portion 72R and the left grip portion 72L are provided on a right side and a left side of the steering handle 71, respectively. Thus, the operator of the first jet propulsion boat 10 can grip the right grip portion 72R and the left grip portion 72L and turn the steering handle 71 right and left. The above-mentioned operation cable for the deflector 51 is mechanically coupled to the steering handle 71, and is configured to turn the deflector 51 right and left by a movement amount corresponding to a movement amount of the steering handle 71. As a result, the jetting direction of the jet flow from the discharge port 51*a* is deflected right and left.

The first operation element 73 includes a first lever that can be moved by the operator within a predetermined first range to change the operation amount. The first lever of the first operation element 73 is axially supported in a vicinity of a base end portion of the right grip portion 72R so as to be turnable. An operation amount (namely, a movement amount of the first lever) of the first operation element 73 is detected by a first position sensor 81 arranged at an upper portion of the first operation element 73. The first position sensor 81 is a well-known potentiometer. Under a state in which a predetermined forward-movement operation described later is carried out on the first lever of the first operation element 73, the output (rotation speed) of the engine 31 is changed in accordance with the operation amount of the first operation element 73. As described above, the first operation element 73 is an operation element having an operation amount that is changeable, and is an operation element to be operated mainly to move the first jet propulsion boat 10 forward.

The second operation element 74 includes a second lever that can be moved by the operator within a predetermined second range to change the operation amount. The second lever of the second operation element 74 is axially supported in a vicinity of a base end portion of the left grip portion 72L so as to be turnable. An operation amount (namely, a movement amount of the second lever) of the second operation element 74 is detected by a second position sensor 82 arranged at an upper portion of the second operation element 74. The second position sensor 82 is a well-known potentiometer. Under a state in which a predetermined forward-movement operation described later is carried out on the second lever of the second operation element 74, the output (rotation speed) of the engine 31 is changed in accordance with the operation amount of the second operation element 74. As described above, the second operation element 74 is an operation element having an operation amount that is changeable, and is an operation element to be operated mainly to move the first jet propulsion boat 10 backward.

Figure 7:
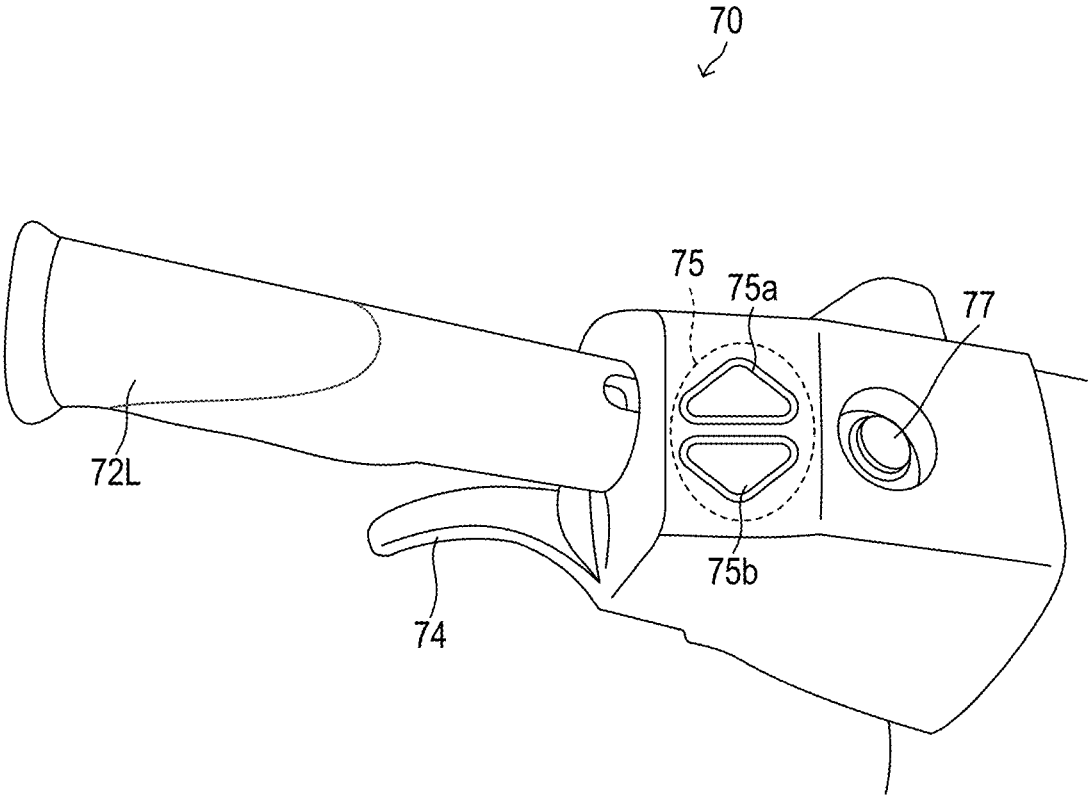
FIG. 7 is a perspective view for illustrating a configuration in a vicinity of a left grip portion of the water jet propulsion boat illustrated in FIG. 1.

The third operation element 75 is a push button switch. As illustrated in FIG. 7, the third operation element 75 includes a forward-movement push button (also referred to as "up switch") 75*a* and a backward-movement push button (also referred to as "down switch") 75*b*. The third operation element 75 is arranged in a vicinity of the left grip portion 72L and on an inner side with respect to the left grip portion 72L in the right-and-left direction. The up switch 75*a* and the down switch 75*b* are arranged in parallel with each other in the up-and-down direction. With such an arrangement of the third operation element 75, the operator can easily operate the third operation element 75 by the thumb of the left hand while gripping the left grip portion 72L by the left hand. When the third operation element 75 is operated under a state in which predetermined neutral operations have been carried out as described later, the position of the jet flow adjustment member 50 is changed in accordance with this operation.

The start switch 76 illustrated in FIG. 6 is arranged on a surface on a front side of the steering handle 71, and in a vicinity of the third operation element 75. The start switch 76 is a push button switch. The start switch 76 is a switch for starting the engine 31.

As illustrated in FIG. 6 and FIG. 7, the stop switch 77 is arranged on a surface on a rear side of the steering handle 71, and on a right side of the third operation element 75. The stop switch 77 is a push button switch. The stop switch 77 is a switch for stopping the engine 31.

Figure 8:
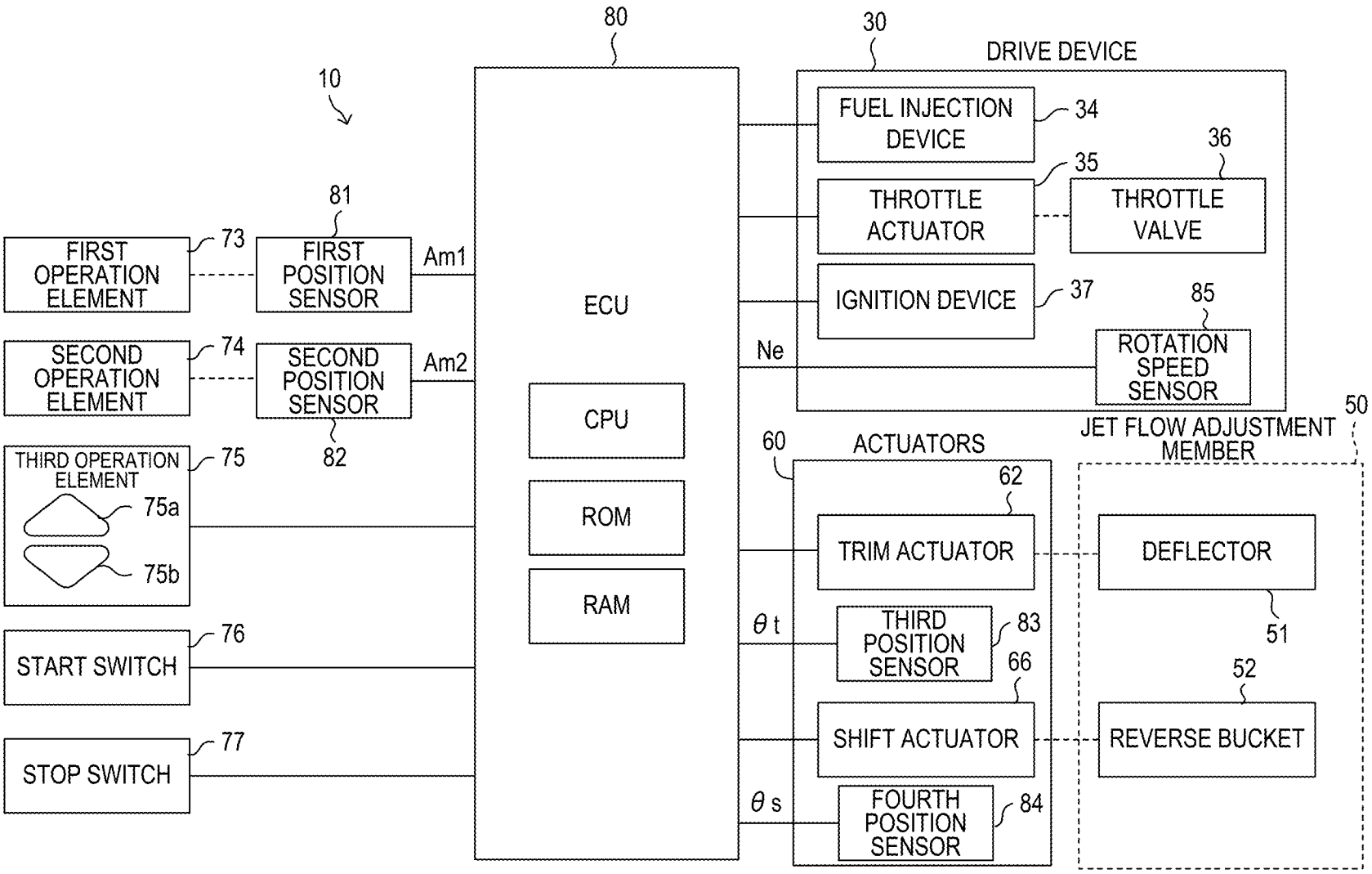
FIG. 8 is a control block diagram of the water jet propulsion boat illustrated in FIG. 1.

As illustrated in FIG. 8, the drive device 30 includes, for example, fuel injection devices 34, a throttle actuator 35, a throttle valve 36, and ignition devices 37. The fuel injection devices 34 are configured to supply fuel into combustion chambers (not shown) of the engine 31. The throttle actuator 35 is configured to change an opening degree of the throttle valve 36. The throttle valve 36 is configured to adjust an intake air amount of the engine 31. The throttle valve 36 is provided in common for a plurality of cylinders of the engine 31. The ignition devices 37 are configured to ignite the fuel (mixture) in the combustion chambers. The fuel injection device 34 and the ignition device 37 are provided for each of the cylinders of the engine 31. The throttle valve 36 may be provided for each of the cylinders of the engine 31.

The ECU 80 is an abbreviation of "electronic control unit", and is an electronic control circuit including a microcomputer as a main component. The microcomputer includes, for example, a CPU, a ROM, a RAM, a backup RAM (or a nonvolatile memory), and an interface I/F. The CPU is configured to execute instructions (routines) stored in the memory (ROM) to implement various functions described later.

The ECU 80 is electrically connected to, for example, the fuel injection devices 34, the throttle actuator 35, the ignition devices 37, the trim actuator 62, and the shift actuator 66. The ECU 80 is electrically connected to, for example, the third operation element 75, the start switch 76, the stop switch 77, the first position sensor 81, the second position sensor 82, a third position sensor 83, a fourth position sensor 84, and a rotation speed sensor 85. The ECU 80 is configured to receive output signals from those switches and sensors.

The first position sensor 81 is configured to generate an output signal indicating an operation amount (first accelerator operation amount) Am1 of the first operation element 73. The second position sensor 82 is configured to generate an output signal indicating an operation amount (second accelerator operation amount) Am2 of the second operation element 74. The third position sensor 83 is configured to generate an output signal indicating a rotation angle θt of the trim actuator 62. The fourth position sensor 84 is configured to generate an output signal indicating a rotation angle θs of the shift actuator 66. The rotation speed sensor 85 is configured to generate an output signal indicating a rotation speed Ne of the crankshaft 32.

The ECU 80 is configured to move the reverse bucket 52 to the forward-movement position when the engine 31 is stopped. Further, the ECU 80 is configured to move the reverse bucket 52 from the forward-movement position to the neutral position when the engine 31 is started. A cruising mode in which the reverse bucket 52 is moved from the forward-movement position to the neutral position is sometimes referred to as "neutral mode".

Under a state in which the reverse bucket 52 is positioned at the neutral position, when the first operation element 73 is operated and the first operation amount Am1 consequently becomes equal to or larger than a predetermined operation amount, the ECU 80 moves the reverse bucket 52 to the forward-movement position, and increases the opening degree of the throttle valve 36 in accordance with a magnitude of the first operation amount Am1. Such a cruising mode is sometimes referred to as "forward-movement mode".

Under a state in which the reverse bucket 52 is positioned at the neutral position, when the second operation element 74 is operated and the second operation amount Am2 consequently becomes equal to or larger than a predetermined operation amount, the ECU 80 moves the reverse bucket 52 to the backward-movement position, and increases the opening degree of the throttle valve 36 in accordance with a magnitude of the second operation amount Am2. Such a cruising mode is sometimes referred to as "backward-movement mode".

When the cruising mode is the forward-movement mode, after the first operation amount Am1 is set to zero and the second operation element 74 is operated for a short period of time, the ECU 80 sets the cruising mode to the neutral mode. When the cruising mode is the backward-movement mode, after the second operation amount Am2 is set to zero, the ECU 80 sets the cruising mode to the neutral mode. When the cruising mode is the neutral mode, the operation state of the engine 31 is maintained in the idling state independently of any one of the first operation amount Am1 and the second operation amount Am2.

(Operation)

As described above, in the first jet propulsion boat 10, the position (the forward-movement position, the backward-movement position, or the neutral position) of the reverse bucket 52 is changed in accordance with the cruising mode. The cruising mode includes a mode in which the boat body 20 can be moved forward and backward through the operation (accelerator operation) on the first operation element 73 and/or the second operation element 74 (hereinafter referred to as "first mode") and a mode in which the accelerator operation is not carried out (hereinafter referred to as "second mode"). That is, the first mode includes the forward-movement mode and the backward-movement mode, and the second mode includes the neutral mode.

In other words, the first mode is a mode in the state in which the predetermined forward-movement operations or the predetermined backward-movement operations have been carried out on the first operation element 73 and the second operation element 74. In the first mode, the jet flow adjustment member 50 is moved to the forward-movement position or the backward-movement position, and the forward-movement thrust and/or the backward-movement thrust is changed through the operation on the first operation element 73 and/or the second operation element 74.

The second mode is a mode in the state in which the predetermined neutral operations have been carried out on the first operation element 73 and the second operation element 74. In the second mode, none of the forward-movement thrust and the backward-movement thrust is changed through the operation on the first operation element 73 and/or the second operation element 74, and the movement position (turn position) of the jet flow adjustment member 50 (the reverse bucket 52 in this example) is adjusted through the operation on the third operation element 75.

In the first mode, the ECU 80 controls the amount of the jet flow jetted out from the discharge port 51*a* based on the operation amount of at least any one of the first operation element 73 and the second operation element 74. More specifically, when the reverse bucket 52 is at the forward-movement position, the ECU 80 controls the throttle actuator 35 in accordance with the operation amount Am1 of the first operation element 73, to thereby change the opening degree of the throttle valve 36. As a result, the amount of the jet flow jetted out from the discharge port 51*a* is adjusted. Consequently, the ECU 80 changes the rotation speed of the engine 31, to thereby adjust the amount of the jet flow jetted out from the discharge port 51*a*. When the reverse bucket 52 is at the backward-movement position, the ECU 80 adjusts the amount of the jet flow jetted out from the discharge port 51*a* based on the operation amount Am2 of the second operation element 74.

In the second mode, the ECU 80 maintains the operation state of the engine 31 in the idling state, and controls the movement position (turn position) of the jet flow adjustment member 50 so as to adjust the difference between the thrust generated by the forward jet flow component (backward-movement thrust) and the thrust generated by the backward jet flow component (forward-movement thrust) based on the operation on the third operation element 75. In other words, when the reverse bucket 52 is at the neutral position, the ECU 80 changes the movement position (turn position) of the reverse bucket 52 based on the operation on the up switch 75*a* or the down switch 75*b* of the third operation element 75. In other words, the ECU 80 controls (adjusts) a ratio (including "0" and "infinity") at which the jet flow jetted out from the discharge port 51*a* of the deflector 51 is to be divided into the forward-movement jet flow JB and the backward-movement jet flow JF.

Figure 9A:
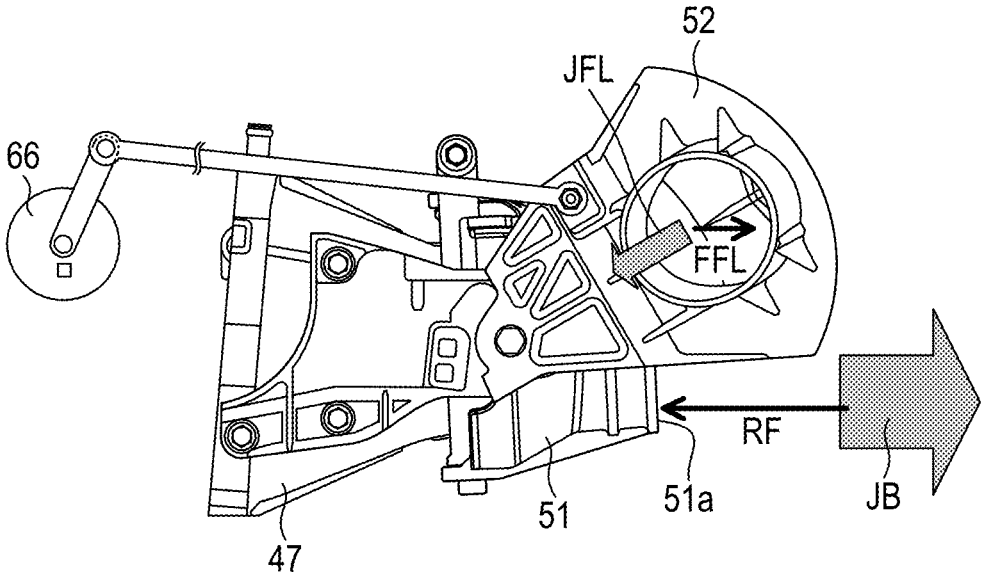
Figure 9B:
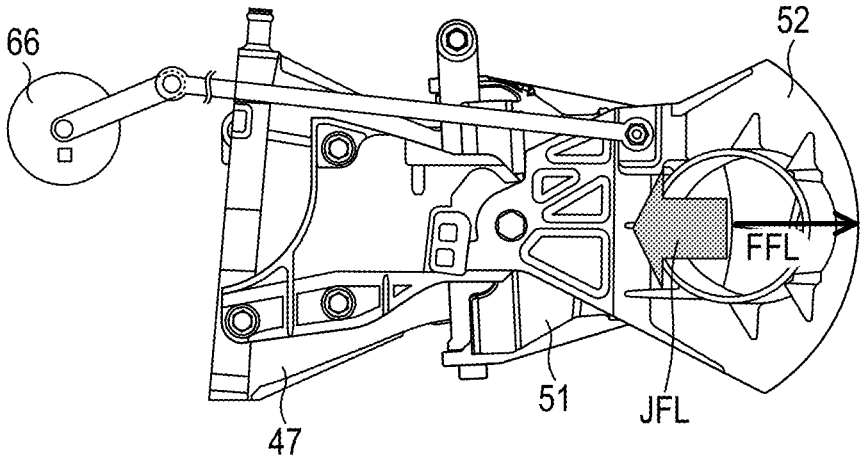

With reference to FIG. 5A, FIG. 9A, and FIG. 9B, description is now made of the jet flow to be divided by the jet flow adjustment member 50 (reverse bucket 52) in the second mode. In the second mode, the position of the deflector 51 is always set to the neutral position.

For description of the thrusts generated by the divided forward-movement jet flow JB and backward-movement jet flow JF, a ratio FF/RF of the "backward-movement thrust FF generated by the forward jet flow component of the backward-movement jet flow JF" to the "forward-movement thrust RF generated by the backward jet flow component of the forward-movement jet flow JB" is defined as a thrust ratio γ (=FF/RF). The jet flow adjustment member 50 is capable of changing the thrust ratio γ in accordance with the turn position of the jet flow adjustment member 50. When the thrust ratio γ is smaller than "1" (including a case in which FF=0 and γ=0), the forward-movement thrust RF is larger than the backward-movement thrust FF. Therefore, the first jet propulsion boat 10 can thus move forward. In contrast, when the thrust ratio γ is larger than "1" (including a case in which RF=0 and γ="infinity"), the backward-movement thrust FF is larger than the forward-movement thrust RF. Therefore, the first jet propulsion boat 10 can thus move backward.

In other words, the jet flow adjustment member 50 is capable of changing the difference between the backward-movement thrust FF and the forward-movement thrust RF (FF-RF) (hereinafter referred to as "thrust difference FF-RF") in accordance with the turn position.

When the ECU 80 moves the reverse bucket 52 to the neutral position as a result of the operation on any one of the first operation element 73 and the second operation element 74, the forward-movement thrust RF and the backward-movement thrust FF substantially balance with each other as described above (see FIG. 5A). Thus, the thrust ratio γ (=FF/RF) is substantially equal to 1. However, in this example, the thrust ratio γ is slightly smaller than 1. In other words, the thrust difference FF-RF is equal to 0 or slightly smaller than 0. Further, the ECU 80 maintains the operation state of the engine 31 in the idling state, and thus the first jet propulsion boat 10 can maintain the boat stop state or can move forward at an extremely low speed on the still water.

As illustrated in FIG. 5A, when the up switch 75*a* of the third operation element 75 is pressed under the state in which the reverse bucket 52 is at the neutral position, the ECU 80 rotates the shift actuator 66 counterclockwise (leftward) by a predetermined angle. That is, as illustrated in FIG. 9A, the ECU 80 turns the position of the reverse bucket 52 upward from the neutral position by a predetermined amount. This position is referred to as "very low-speed forward-movement position".

In this case, the area of the discharge port 51*a* exposed outside the reverse bucket 52 increases from that exhibited when the reverse bucket 52 is at the neutral position in rear view. Meanwhile, the area of the discharge port 51*a* covered with the reverse bucket 52 decreases from that exhibited when the reverse bucket 52 is at the neutral position. Thus, in this case, the backward jet flow component increases and the forward jet flow component decreases as compared with the case in which the reverse bucket 52 is at the neutral position. That is, the forward-movement thrust RF increases, and the backward-movement thrust FF decreases. Thus, the thrust ratio γ (=FF/RF) falls below 1. In other words, the thrust difference FF-RF becomes a negative value, and the magnitude thereof increases.

Incidentally, as described above, when the reverse bucket 52 is at the forward-movement position, the backward-movement thrust FF is not generated. That is, the thrust ratio γ (=FF/RF) is substantially equal to 0 when the reverse bucket 52 is at the forward-movement position. The thrust ratio γ (=FF/RF) given on this occasion is hereinafter referred to as "first value". In other words, the thrust difference FF-RF is minimized. That is, when the reverse bucket 52 is at the very low-speed forward-movement position, the generated forward-movement thrust RF is small as compared with the case in which the reverse bucket 52 is at the forward-movement position. In this case, the ECU 80 maintains the operation state of the engine 31 in the idling state, and the first jet propulsion boat 10 can thus move forward at very low speed.

When the down switch 75*b* of the third operation element 75 is pressed under the state in which the reverse bucket 52 is at the neutral position (see FIG. 5A), the ECU 80 rotates the shift actuator 66 clockwise (rightward) by a predetermined angle. That is, as illustrated in FIG. 9B, the ECU 80 turns the position of the reverse bucket 52 downward from the neutral position by a predetermined amount. This position is referred to as "very low-speed backward-movement position".

In this case, the area of the discharge port 51*a* exposed outside the reverse bucket 52 decreases from that exhibited when the reverse bucket 52 is at the neutral position in rear view. Meanwhile, the area of the discharge port 51*a* covered with the reverse bucket 52 increases from that exhibited when the reverse bucket 52 is at the neutral position. Thus, in this case, the backward jet flow component decreases and the forward jet flow component increases as compared with the case in which the reverse bucket 52 is at the neutral position. That is, the forward moving thrust RF decreases, and the backward-movement thrust FF increases. Thus, the thrust ratio γ (=FF/RF) becomes larger than 1. In other words, the thrust difference FF-RF becomes a positive value, and the magnitude thereof increases.

Incidentally, in this example, the reverse bucket 52 is moved to the same position when the reverse bucket 52 is at the very low-speed backward-movement position and when the reverse bucket 52 is at the backward-movement position (see FIG. 3A). That is, the discharge port 51*a* is completely covered with the reverse bucket 52 in rear view in any of the cases. Thus, when the reverse bucket 52 is at the very low-speed forward-movement position, the backward jet flow component (forward-movement jet flow JB) hardly exists, and the forward-movement thrust RF is substantially "0". Thus, the thrust ratio γ (=FF/RF) becomes an extremely large value. The thrust ratio γ (=FF/RF) given on this occasion is hereinafter referred to as "second value". In other words, the thrust difference FF-RF is maximized. However, the ECU 80 maintains the operation state of the engine 31 in the idling state. Thus, the first jet propulsion boat 10 can move backward at very low speed.

When the down switch 75*b* is pressed under the state in which the position of the reverse bucket 52 is the very low speed forward-movement position, the ECU 80 moves the position of the reverse bucket 52 to the neutral position. Similarly, when the up switch 75*a* is pressed under the state in which the position of the reverse bucket 52 is the very low speed backward-movement position, the ECU 80 moves the position of the reverse bucket 52 to the neutral position.

(Specific Operation of First Jet Propulsion Boat)

Figure 10:
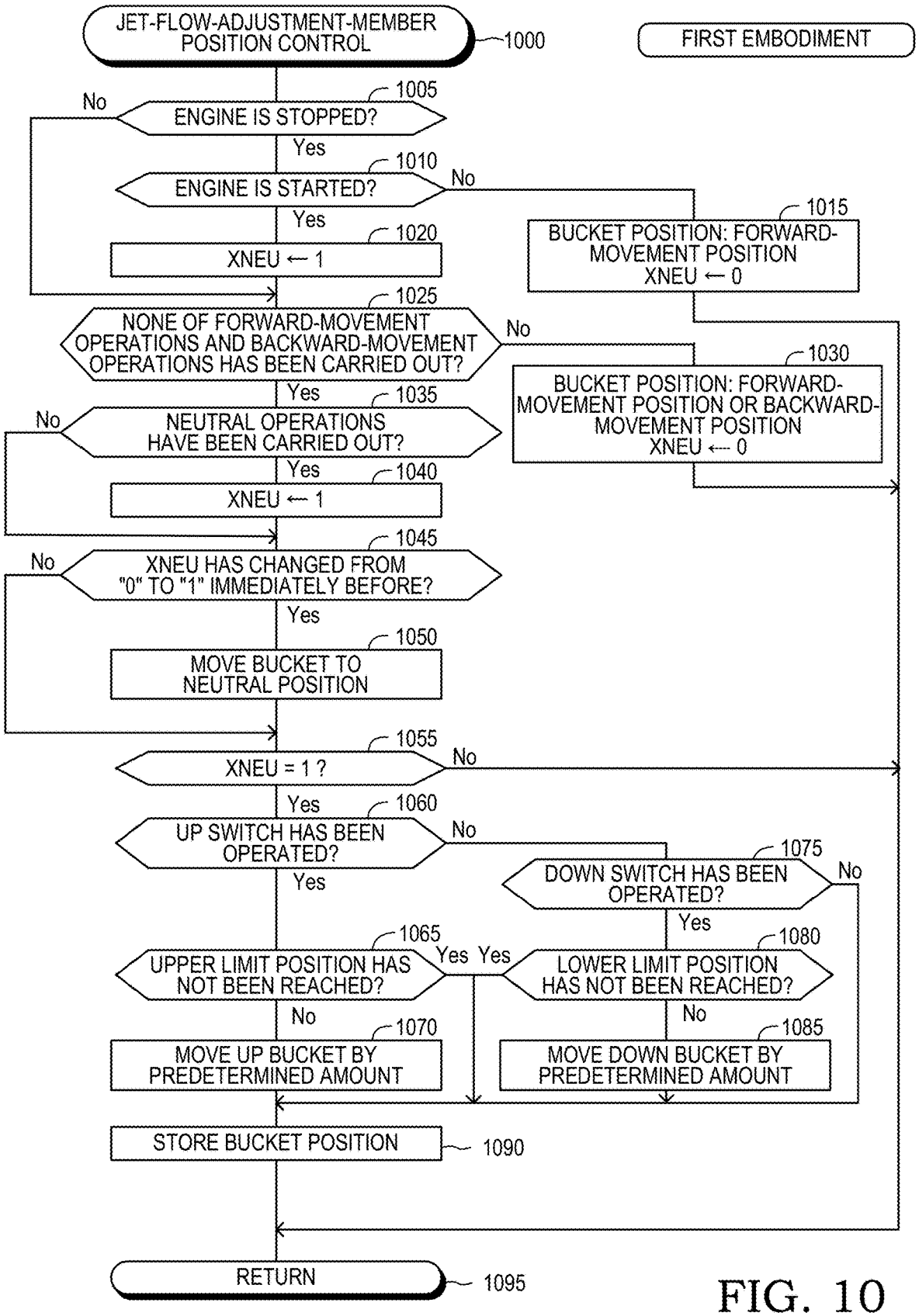
FIG. 10 is a flowchart for illustrating a "jet-flow-adjustment-member position control routine" to be executed by a CPU of an ECU illustrated in FIG. 1.

With reference to FIG. 10, description is now made of an actual operation of the first jet propulsion boat 10.

The CPU of the ECU 80 is configured to execute a jet-flow-adjustment-member position control routine illustrated by a flowchart of FIG. 10 every time a constant time elapses when a ready switch (not shown) has been operated to an on position. Description is now made of respective cases. A value of a neutral position flag XNEU is set to "0" by an initial routine to be executed independently. The CPU moves up the reverse bucket 52 to the forward-movement position when the engine 31 is stopped, and moves down the reverse bucket 52 to the neutral position when the engine 31 is started.

(1) Case in which none of first operation element, second operation element, and third operation element is operated after engine is started The CPU starts the process from Step 1000 at a predetermined time point to proceed to Step 1005 at which the CPU determines whether the engine 31 is stopped based on whether the engine rotation speed Ne is equal to or less than a first rotation speed Ne1.

The engine 31 is stopped at the current time point. Thus, the CPU makes "Yes" determination at Step 1005 to proceed to Step 1010 at which determines whether the engine 31 has been started based on whether the start switch 76 has been pressed.

When the start switch 76 has not been pressed, the CPU makes "No" determination at Step 1010 to proceed to Step 1015 at which the CPU sets the position of the reverse bucket 52 to the forward-movement position. The reverse bucket 52 is stopped at the forward-movement position before the engine start, and thus the position of the reverse bucket 52 does not actually change. Further, the CPU sets the value of the neutral position flag XNEU to "0" at Step 1015 to directly proceed to Step 1095 at which the CPU tentatively terminates the present routine. The flag XNEU is a flag indicating that the cruising mode is the neutral mode when the value of the flag XNEU is "1".

When the start switch 76 is pressed under this state, the CPU makes "Yes" determination at Step 1010 to proceed to Step 1020 at which the CPU sets the value of the flag XNEU to "1", and then proceeds to Step 1025.

The CPU determines whether none of the forward-movement operations and the backward-movement operations has been carried out at Step 1025. Based on the above-mentioned assumption, none of the forward-movement operations and the backward-movement operations has been carried out, and thus, the CPU thus makes "Yes" determination at Step 1025 to proceed to Step 1035 at which the CPU determines whether the neutral operations have been carried out. Based on the above-mentioned assumption, the neutral operations have not been carried out. Thus, the CPU makes "No" determination at Step 1035 to directly proceed to Step 1045 at which the CPU determines whether the value of the flag XNEU has changed from "0" to "1" immediately before.

As described above, the value of the flag XNEU has changed from "0" to "1" immediately before at Step 1020, and thus, the CPU makes "Yes" determination at Step 1045. Then, the CPU proceeds to Step 1050 to move the reverse bucket 52 to the above-mentioned neutral position.

Then, the CPU proceeds to Step 1055 to determine whether the value of the flag XNEU is "1". At the current time point, the value of the flag XNEU is "1". Thus, the CPU makes "Yes" determination at Step 1055 to proceed to Step 1060 at which the CPU determines whether the forward-movement push button (up switch) 75*a* has been operated. Based on the above-mentioned assumption, the up switch 75*a* has not been operated. Thus, the CPU makes "No" determination at Step 1060 to proceed to Step 1075 at which the CPU determines whether the backward-movement push button (down switch) 75*b* has been operated. Based on the above-mentioned assumption, the down switch 75*b* has not been operated. Thus, the CPU makes "No" determination at Step 1075 to directly proceed to Step 1090 at which the CPU stores the position of the reverse bucket 52 (in this case, the neutral position) at the current time point. Then, the CPU proceeds to Step 1095 to tentatively terminate the present routine.

(2) Case in which cruising mode is neutral mode (flag XNEU=1) and third operation element is operated after engine is started In this case, the CPU proceeds from Step 1000 to Step 1005. The CPU makes "No" determination at Step 1005 to proceed to Step 1025. Also the CPU makes "Yes" determination at Step 1025 to proceed to Step 1035. Further, the CPU makes "No" determination at Step 1035 to proceed to Step 1045. The value of the flag XNEU is maintained to be "1". Thus, the CPU makes "No" determination at Step 1045 to directly proceed to Step 1055. Further, the CPU makes "Yes" determination at Step 1055 to proceed to Step 1060.

When the up switch 75*a* has been operated, the CPU makes "Yes" determination at Step 1060 to proceed to Step 1065 at which the CPU determines whether the position of the reverse bucket 52 at the current time point has not reached a "predetermined upper limit position in the neutral mode". This predetermined upper limit position is a position between the neutral position and the forward-movement position. The predetermined upper limit position may be the forward-movement position.

Assuming that the position of the reverse bucket 52 has not reached the upper limit position, the CPU makes "No" determination at Step 1065 to proceed to Step 1070 at which the CPU turns the reverse bucket 52 upward by a predetermined angle so that the position of the reverse bucket 52 approaches the forward-movement position. As a result, the forward-movement thrust RF increases, and the backward-movement thrust FF decreases. Then, the CPU carries out the process at Step 1090 to proceed to Step 1095.

In contrast, when the position of the reverse bucket 52 has reached the upper limit position at a time point at which the CPU carries out the process at Step 1065, the CPU makes "Yes" determination at Step 1065 to directly proceed to Step 1090. Then, the CPU proceeds to Step 1095 to tentatively terminate the present routine. That is, in this case, even when the up switch 75*a* has been operated, the position of the reverse bucket 52 is maintained at the upper limit position.

Meanwhile, when the down switch 75*b* has been operated at a time point at which the CPU carries out the process at Step 1060, the CPU makes "No" determination of "No" at Step 1060 to proceed to Step 1075 at which the CPU determines whether the down switch 75*b* has been operated. Based on the above-mentioned assumption, in Step 1075, the CPU makes "Yes" determination at Step 1075 to proceed to Step 1080 at which the CPU determines whether the position of the reverse bucket 52 at the current time point has not reached a "predetermined lower limit position in the neutral mode". This predetermined lower limit position is the backward-movement position. The predetermined lower limit position may be a position between the neutral position and the backward-movement position.

When the position of the reverse bucket 52 has not reached the lower limit position, the CPU makes "No" determination of "No" at Step 1080 to proceed to Step 1085 at which the CPU turns the reverse bucket 52 downward by a predetermined angle so that the position of the reverse bucket 52 approaches the backward-movement position. As a result, the forward moving thrust RF decreases, and the backward-movement thrust FF increases. Then, the CPU carries out the process at Step 1090 to proceed to Step 1095.

In contrast, when the position of the reverse bucket 52 has reached the lower limit position at a time point at which the CPU carries out the process at Step 1080, in Step 1080, the CPU makes "Yes" determination at Step 1080 to directly proceed to Step 1090. Then, the CPU proceeds to Step 1095 to tentatively terminate the present routine. That is, in this case, even when the down switch 75*b* has been operated, the position of the reverse bucket 52 is maintained at the lower limit position.

(3) Case in which any one of forward-movement operations and backward-movement operations has been carried out after engine is started In this case, in Step 1005, the CPU makes a determination of "No", and proceeds to Step 1025. Based on the above-mentioned assumption, any one of the forward-movement operations or the backward-movement operations have been carried out. Thus, the CPU makes "No" determination at Step 1025 to proceed to Step 1030. When the forward-movement operations have been carried out, the CPU moves the position of the reverse bucket 52 to the forward-movement position. When the backward-movement operations have been carried out, the CPU moves the position of the reverse bucket 52 to the backward-movement position. Further, the CPU sets the value of the neutral position flag XNEU to "0", and directly proceeds to Step 1095 to tentatively terminate the present routine.

(4) Case in which cruising mode is forward-movement mode or backward-movement mode (flag XNEU=0) and neutral operations are carried out after engine start In this case, the value of the flag XNEU has been set to "0" through the process at Step 1030. The CPU makes "No" determination at Step 1005, and makes "Yes" determination at Step 1025. Then, the CPU makes "Yes" determination at Step 1035 to proceed to Step 1040 at which the CPU sets the value of the flag XNEU to "1". That is, the CPU changes the value of the flag XNEU from "0" to "1" at Step 1040.

Then, the CPU makes "Yes" determination at Step 1045 to proceed to Step 1050 at which the CPU changes the position of the reverse bucket 52 from the forward-movement position or the backward-movement position to the neutral position. Then, the CPU makes "Yes" determination at Step 1055 to proceed to Step 1060 and the subsequent steps. As a result, the CPU controls the turn position of the reverse bucket 52 in accordance with the operation on the third operation element 75.

As described above, when the forward-movement operations are carried out, the ECU 80 sets the turn position of the deflector 51 about the horizontal axis to the neutral position, and sets the turn position of the reverse bucket 52 to a first position (forward-movement position), which is a position at which the forward jet flow component is not generated and the backward jet flow component is generated from the jet flow jetted out through the deflector 51. Further, when the backward-movement operations are carried out, the ECU 80 sets the turn position of the deflector 51 about the horizontal axis to the neutral position, and sets the turn position of the reverse bucket 52 to a second position (backward-movement position), which is a position at which at least the forward jet flow component is generated from the jet flow jetted out through the deflector 51. In such a manner, the cruising mode at the time when the ECU 80 sets the reverse bucket 52 to the forward-movement position or the backward-movement position corresponds to the first mode.

Meanwhile, when the neutral operations are carried out, the ECU 80 sets the turn position of the deflector 51 about the horizontal axis to the neutral position, and sets the turn position of the reverse bucket 52 to a third position (neutral position), which is a position at which the forward jet flow component and the backward jet flow component are generated from the jet flow jetted out through the deflector 51. In such a manner, the cruising mode at the time when the ECU 80 sets the reverse bucket 52 to the neutral position corresponds to the second mode.

One of the features of the movement position control for the jet flow adjustment member 50 to be carried out by the ECU 80 is described as follows when the ratio (thrust ratio γ (=FF/RF)) of the backward-movement thrust FF to the forward-movement thrust RF is defined.

The ECU 80 causes the actuator 60 to change the turn position of the jet flow adjustment member 50 so that:

(1) when the forward-movement operations are carried out on the first operation element 73 and the second operation element 74, the thrust ratio γ becomes the first value smaller than 1;

(2) when the backward-movement operations are carried out on the first operation element 73 and the second operation element 74, the thrust ratio γ becomes the second value smaller than 1; and (3) when the neutral operations are carried out on the first operation element 73 and the second operation element 74, the thrust ratio γ becomes the third value larger than the first value and smaller than the second value.

Further, when the third operation element 75 has been operated under the state in which the neutral operations have been carried out, the ECU 80 maintains the operation state of the engine 31 in the idling state, and causes the actuator 60 to change the turn position of the jet flow adjustment member 50 so that the thrust ratio γ changes in the "range equal to or larger than the first value and equal to or smaller than the second value".

When the definition of the difference (thrust difference FF-RF) between the backward-movement thrust FF and the forward-movement thrust RF is used, the above-mentioned feature can be described as follows.

Specifically, the ECU 80 causes the actuator 60 to change the turn position of the jet flow adjustment member 50 so that:

(1) when the forward-movement operations are carried out on the first operation element 73 and the second operation element 74, the thrust difference FF-RF becomes the first value smaller than 0;

(2) when the backward-movement operations are carried out on the first operation element 73 and the second operation element 74, the thrust difference FF-RF becomes the second value larger than 0; and (3) when the neutral operations are carried out on the first operation element 73 and the second operation element 74, the thrust difference FF-RF becomes the third value larger than the first value and smaller than the second value.

Further, when the third operation element 75 has been operated under the state in which the neutral operations have been carried out, the ECU 80 maintains the operation state of the engine 31 in the idling state, and causes the actuator 60 to change the turn position of the jet flow adjustment member 50 so that the thrust difference FF-RF changes in the "range equal to or larger than the first value and equal to or smaller than the second value".

As a result, with the first jet propulsion boat 10, while the operation state of the engine 31 is maintained in the idling state in the second mode, the movement position of the jet flow adjustment member 50 is controlled based on the operation on the third operation element 75, to thereby adjust the difference between the thrust generated by the forward jet flow component and the thrust generated by the backward jet flow component. As a result, a water jet propulsion boat capable of moving forward and moving backward at very low speed through a simple operation can be provided.

Further, according to the first embodiment, after the reverse bucket 52 moves from the predetermined initial position by the predetermined amount within the range of the neutral position for the forward movement or the backward movement at a very low speed when the reverse bucket 52 is at the neutral position, when the reverse bucket 52 moves to the forward-movement position or the backward-movement position as a result of any one of the forward-movement operations or the backward-movement operations, and then moves again to the neutral position, the reverse bucket 52 moves to the predetermined initial position. In other words, when the reverse bucket 52 moves to the neutral position through the neutral operations, the reverse bucket 52 always moves to the predetermined initial position.

Thus, with the first jet propulsion boat, even when any one of the forward-movement operations and the backward-movement operations are carried out between the neutral operations immediately before (for example, first neutral operations) and the current neutral operations (for example, second neutral operations), the thrust generated immediately after the neutral operations is always the predetermined thrust. Thus, even when any operation is carried out on the third operation element 75 under the state in which the first neutral operations have been carried out, the operator can obtain the same thrust as that obtained at the start time point of the first neutral operations without operating the third operation element 75 at the start time point of the second neutral operations.

As a result, the operator can operate the third operation element 75 while assuming that the turn position of the reverse bucket 52 is the same position each time the operator carries out the neutral operations. Therefore, operability can be increased when the first jet propulsion boat is moved forward at very low speed, is moved backward at very low speed, or is maintained in the boat stop state.

As described above, the output of the engine 31 is changed in accordance with the operation amount of the first operation element 73 and/or the operation amount of the second operation element 74 in the first mode (under the state in which the forward-movement operations and/or the backward-movement operations have been carried out). Incidentally, it is also conceivable to provide such a configuration that "when the operation amount of the first operation element 73 or the operation amount of the second operation element 74 increases from '0' to a certain value in the second mode (under the state in which the neutral operations have been carried out), the operation state of the engine 31 is maintained in the idling state, and the movement position of the jet flow adjustment member 50 is controlled so as to adjust the difference between the thrust generated by the forward jet flow component and the thrust generated by the backward jet flow component".

In this case, a part of the operation amount of the first operation element 73 and/or the second operation element 74 is assigned to the adjustment operation for the difference between the thrust generated by the forward jet flow component and the thrust generated by the backward jet flow component in the second mode, and the rest is assigned to the output change operation for the engine 31 in the first mode. However, when the first operation element 73 and the second operation element 74 include such levers as described above, it is difficult to provide large movable ranges of the first and second levers in terms of the operability. Therefore, with the above-mentioned configuration, the movement ranges of the first and second levers that can be operated to change the output of the engine 31 are narrow. As a result, the operation of adjusting the output of the engine 31 may become difficult.

In contrast, in the first jet propulsion boat 10, the operation of changing the movement position of the jet flow adjustment member 50 is carried out through use of the third operation element 75. Thus, an entire first range over which the first lever of the first operation element 73 can move can be used to adjust the engine output. An entire second range over which the second lever of the second operation element 74 can move can also be used to adjust the engine output. As a result, the operation on the first operation element 73 and/or the second operation element 74 to adjust the engine output (that is, the speed) is easy, and the forward movement at very low speed and/or the backward movement at very low speed can be achieved through a simple operation on the third operation element 75.

Further, the third operation element 75 includes the forward-movement push button (up switch) 75*a* and the backward-movement push button (down switch) 75*b*. With this mode, the thrust RF generated by the backward jet flow component can slightly be increased, and the thrust FF generated by the forward jet flow component can slightly be decreased by the operator operating the forward-movement push button 75*a*. As a result, the operator can, for example, slightly increase the forward moving speed of the first jet propulsion boat 10. Similarly, the thrust generated by the forward jet flow component can slightly be increased, and the thrust generated by the backward jet flow component can slightly be decreased by the operator operating the backward-movement push button 75*b*. As a result, the operator can, for example, slightly increase the backward moving speed of the first jet propulsion boat 10.

Second Embodiment

Description is now made of a water jet propulsion boat (hereinafter also referred to as "second jet propulsion boat 10A") according to a second embodiment of the present invention. The control device (ECU) of the first jet propulsion boat 10 always moves the position of the reverse bucket 52 to the neutral position when the neutral operations have been carried out. The second jet propulsion boat 10A is different from the first jet propulsion boat 10 in that the movement position of the reverse bucket 52 at a time point immediately before any one of the forward-movement operations and the backward-movement operations is stored, and the reverse bucket 52 is moved to the stored movement position when the neutral operations are carried out next. Description is now mainly made of this difference.

(Specific Operation of Second Jet Propulsion Boat)

Figure 11:
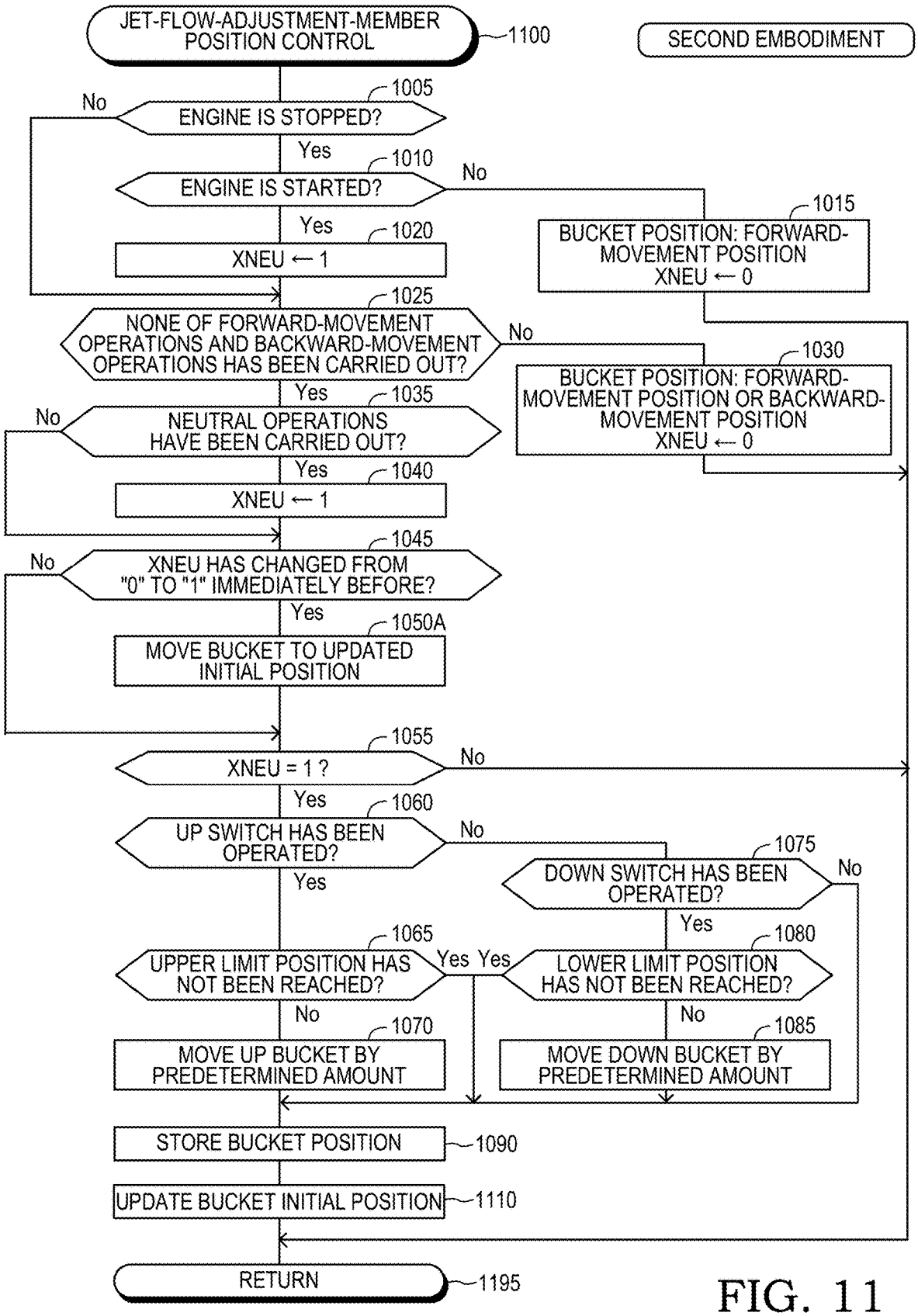
FIG. 11 is a flowchart for illustrating a "jet-flow-adjustment-member position control routine" to be executed by a CPU of an ECU of a water jet propulsion boat according to a second embodiment of the present invention.

With reference to FIG. 11, description is made of an actual operation of the second jet propulsion boat 10A.

A CPU of the ECU 80 of the second jet propulsion boat 10A is configured to execute a jet-flow-adjustment-member-position control routine illustrated by a flowchart of FIG. 11 every time a constant time elapses. The same steps as those referred to in the description of the operation of the first jet propulsion boat 10 are denoted by the same reference symbols.

At Step 1110, the CPU of the second jet propulsion boat 10A uses the position of the reverse bucket 52 stored at Step 1090 for the update to a new initial position of the reverse bucket 52. Then, at Step 1050A, which replaces Step 1050 of FIG. 10, the CPU moves the reverse bucket 52 to the initial position of the reverse bucket 52 updated at Step 1110 of the routine executed immediately before.

Thus, with the second jet propulsion boat 10A, when any one of the forward-movement operations and the backward-movement operations are carried out under the state in which the neutral operations (first neutral operations) have been carried out, and then new neutral operations (second neutral operations) are carried out, the thrust generated when the second neutral operations are started can be made equal to the thrust that has been generated when the first neutral operations are finished.

Thus, even when any one of the forward-movement operations and the backward-movement operations have been carried out between the neutral operations (between the first neutral operations and the second neutral operations), the operator can obtain the same thrust as that obtained at the end time point of the first neutral operations without operating again the third operation element 75 at the start time point of the second neutral operations. Thus, for example, when the second jet propulsion boat is cruising in a river having approximately the same strength of flow, operability can be increased when the second jet propulsion boat is maintained in the boat stop state at different locations on the river.

Third Embodiment

Description is now made of a water jet propulsion boat (hereinafter also referred to as "third jet propulsion boat 10B") according to a third embodiment of the present invention. The control device (ECU) of the first jet propulsion boat 10 carries out the forward movement at very low speed and the backward movement at very low speed by moving the position of the reverse bucket 52 in accordance with the operation on the third operation element 75 when the neutral operations have been carried out. In contrast, the third jet propulsion boat 10B is different from the first jet propulsion boat 10 and the second jet propulsion boat 10A in that the forward movement at very low speed or the backward movement at very low speed is carried out by moving the position of the deflector 51 in accordance with the operation on the third operation element 75 when the neutral operations have been carried out. Description is now mainly made of this difference.

Figure 12A:
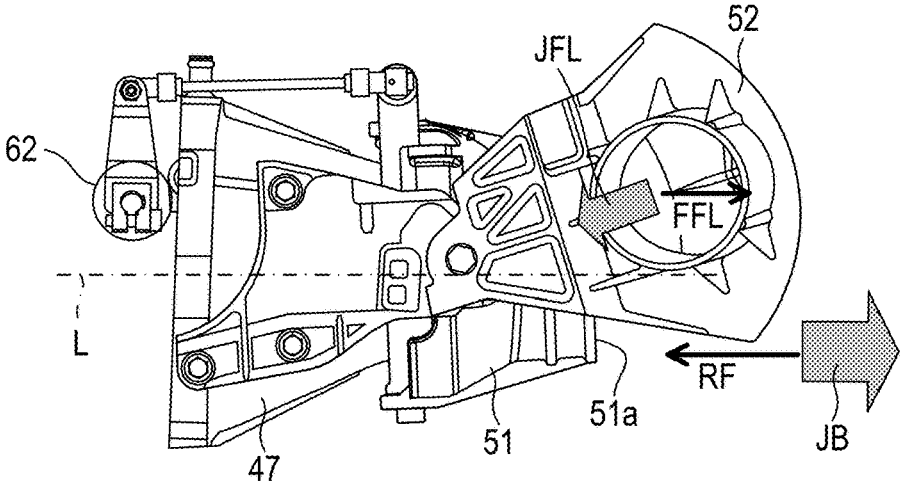

As illustrated in FIG. 12A, when the ECU 80 has turned the reverse bucket 52 to the neutral position, and has turned the deflector 51 to the neutral position, the jet flow jetted out from the discharge port 51*a* is divided into the forward-movement jet flow JB, the left jet flow JFL, and the right jet flow JFR, which is not shown, and is symmetrical with the left jet flow JFL in the right-and-left direction. In this case, the magnitude of the thrust RF generated by the backward jet flow component of the forward-movement jet flow JB and the magnitude of the sum of the thrust FFL generated by the forward jet flow component of the left jet flow JFL and the thrust FFR generated by the forward jet flow component of the right jet flow JFR (not shown) are approximately equal to each other. Thus, at this time, the third jet propulsion boat 10B can maintain the boat stop state.

Figure 12B:
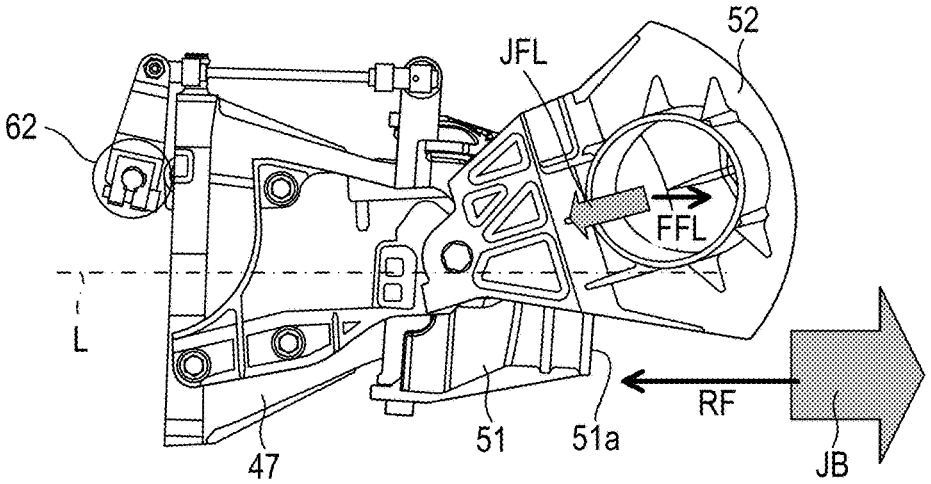

As illustrated in FIG. 12B, when the ECU 80 has turned the reverse bucket 52 to the neutral position, and has turned the deflector 51 to the "downward position", a ratio of the jet flow jetted out from the discharge port 51*a* blocked by the reverse bucket 52 decreases as compared with the case in which the position of the deflector 51 is turned to the neutral position. Meanwhile, at this time, the jet flow from the discharge port 51*a*, which is not blocked by the reverse bucket 52 and moves backward, increases as compared with the case in which the position of the deflector 51 is turned to the neutral position. That is, the forward-movement jet flow JB increases, and each of the left jet flow JFL and the right jet flow JFR (not shown) decreases.

Figure 12C:
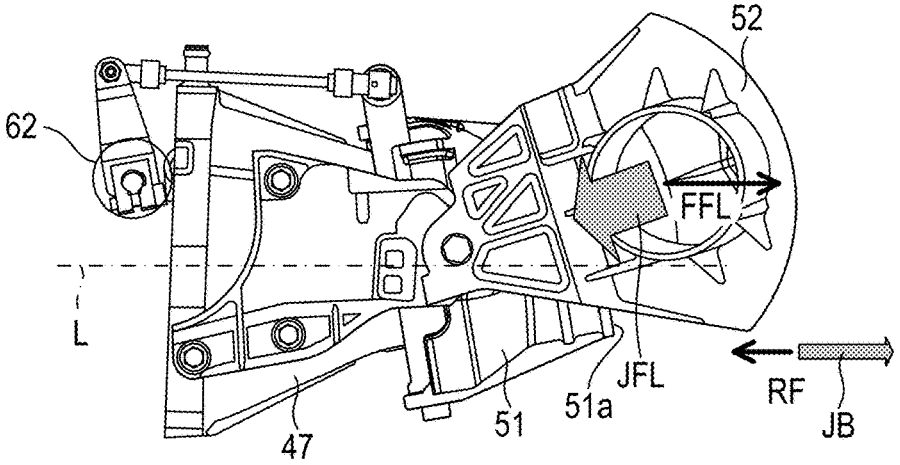

As illustrated in FIG. 12C, when the ECU 80 has turned the reverse bucket 52 to the neutral position, and has moved the deflector 51 to the "upward position", a ratio of the jet flow jetted out from the discharge port 51*a* blocked by the reverse bucket 52 increases as compared with the case in which the position of the deflector 51 is turned to the neutral position. Meanwhile, at this time, the jet flow from the discharge port 51*a*, which is not blocked by the reverse bucket 52 and moves backward, decreases as compared with the case in which the position of the deflector 51 is turned to the neutral position. That is, the forward-movement jet flow JB decreases, and each of the left jet flow JFL and the right jet flow JFR (not shown) increases.

(Specific Operation of Third Jet Propulsion Boat)

Figure 13:
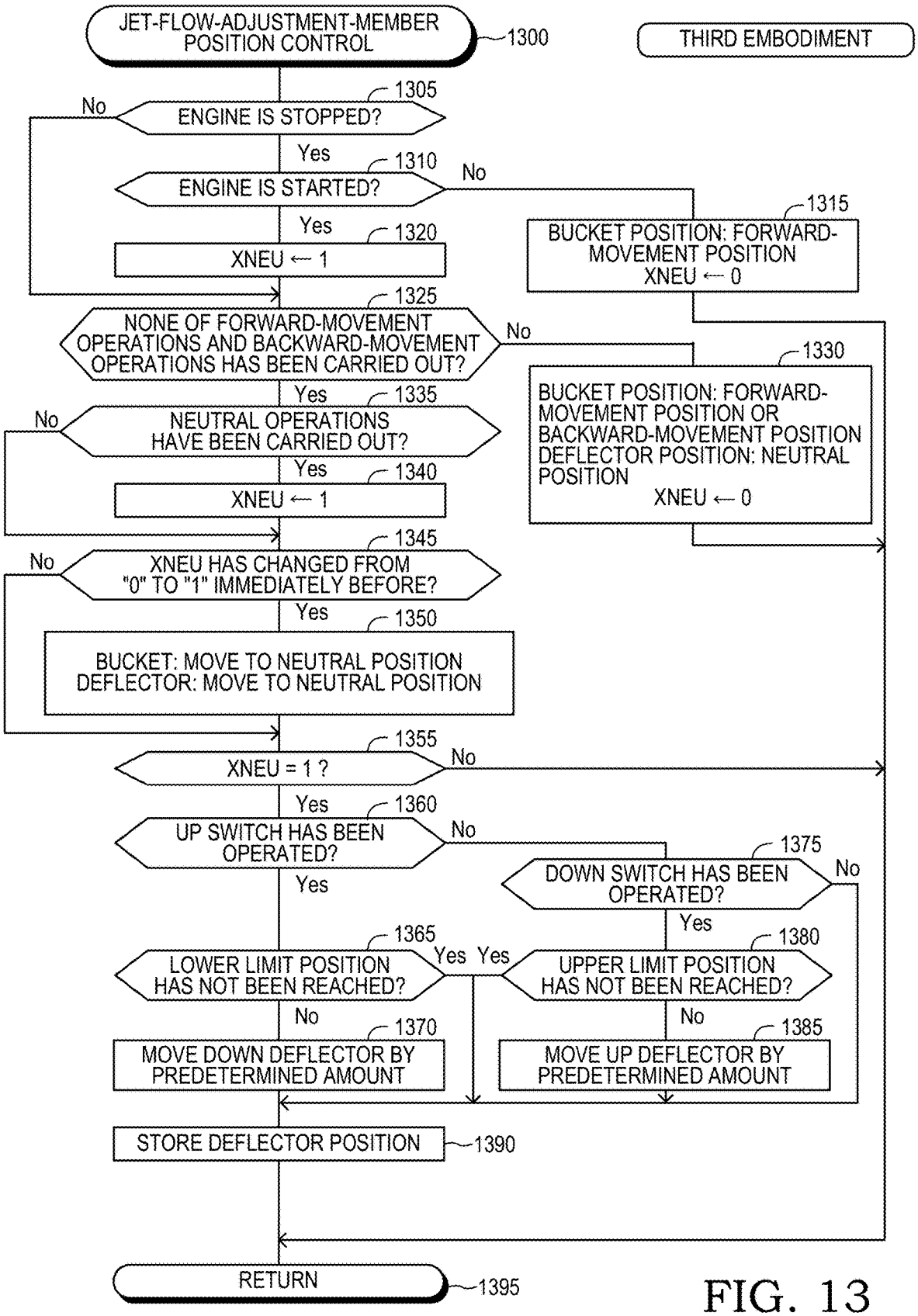
FIG. 13 is a flowchart for illustrating a "jet-flow-adjustment-member position control routine" to be executed by a CPU of an ECU of a water jet propulsion boat according to a third embodiment of the present invention.

With reference to FIG. 13, description is now made of an actual operation of the third jet propulsion boat.

A CPU of the ECU 80 is configured to execute a jet-flow-adjustment-member position control routine illustrated by a flowchart of FIG. 13 every time a constant time elapses. Description is now made of respective cases. Description may not be made of a step in which the same process as that of the flowchart of FIG. 10 is carried out.

(1) Case in which none of first operation element, second operation element, and third operation element is operated after engine is started The CPU starts the process from Step 1300 at a predetermined time point. For example, when the neutral operations are carried out, and the value of the neutral position flag XNEU is set to "1", the CPU makes "Yes" determination at Step 1345 to proceed to Step 1350 at which the CPU moves the reverse bucket 52 to the neutral position and moves the deflector 51 to the neutral position. Then, the CPU proceeds to Step 1355, the CPU makes "Yes" determination at Step 1355 to proceed to Step 1360.

When the third operation element 75 is not operated, the CPU makes "No" determination at each of Step 1360 and Step 1375 to directly proceed to Step 1390. The CPU stores the position (the neutral position in this case) of the deflector 51 at this time point at Step 1390, and proceeds to Step 1395 to tentatively terminate the present routine.

(2) Case in which cruising mode is neutral mode and third operation element is operated after engine is started When the up switch 75*a* has been operated, the CPU makes "Yes" determination at Step 1360 to proceed to Step 1365 at which the CPU determines whether the position of the deflector 51 at the current time point has not reached a "predetermined lower limit position in the neutral mode". This predetermined lower limit position is a "downward position". The predetermined lower limit position may be a position between the neutral position and the downward position.

Assuming that the position of the deflector 51 has not reached the lower limit position, the CPU makes "No" determination at Step 1365 "No" to proceed to Step 1370 at which the CPU turns the deflector 51 downward by a predetermined angle so that the position of the deflector 51 approaches the downward position. As a result, the forward-movement thrust RF increases, and the backward-movement thrust FF decreases. Then, the CPU carries out the process at Step 1390 to proceed to Step 1395.

In contrast, when the position of the deflector 51 has reached the lower limit position at a time point at which the CPU carries out the process at Step 1365, the CPU makes "Yes" determination at Step 1365 to directly proceed to Step 1390. Then, the CPU proceeds to Step 1395 to tentatively terminate the present routine. That is, in this case, even when the up switch 75*a* has been operated, the position of the deflector 51 is maintained at the lower limit position.

Meanwhile, when the down switch 75*b* has been operated at a time point at which the CPU carries out the process at Step 1360, the CPU makes "No" determination at Step 1360 to proceed to Step 1375 at which the CPU determines whether the down switch 75*b* has been operated. Based on the above-mentioned assumption, the CPU makes "Yes" determination at Step 1375 to proceed to Step 1380 at which the CPU determines whether the position of the deflector 51 at the current time point has not reached a "predetermined upper limit position in the neutral mode". This predetermined upper limit position is the "upward position". The predetermined upper limit position may be a position between the neutral position and the upward position.

Assuming that the position of the deflector 51 has not reached the upper limit position, the CPU makes "No" determination at Step 1380 to proceed to Step 1385 at which the CPU turns the deflector 51 upward by a predetermined angle so that the position of the deflector 51 approaches the upward position. As a result, the forward-movement thrust RF decreases, and the backward-movement thrust FF increases. Then, the CPU carries out the process at Step 1390 to proceed to Step 1395.

In contrast, when the position of the deflector 51 has reached the upper limit position at a time point at which the CPU carries out the process at Step 1380, the CPU makes "Yes" determination at Step 1380 to directly proceed to Step 1390. Then, the CPU proceeds to Step 1395 to tentatively terminates the present routine. That is, in this case, even when the down switch 75*b* has been operated, the position of the deflector 51 is maintained at the upper limit position.

As described above, in the third embodiment, when the third operation element 75 has been operated under the state in which the neutral operations have been carried out, the ECU 80 sets the turn position of the reverse bucket 52 to the third position (neutral position), and sets the turn position of the deflector 51 about the horizontal axis to a position different from the neutral position.

Further, in the third embodiment, after the deflector 51 is moved by the predetermined amount from the neutral position within the movable range for the very low-speed forward movement or the very low-speed backward movement when the reverse bucket 52 is at the neutral position, when any one of the forward-movement operations or the backward-movement operations are carried out, the deflector 51 moves to the neutral position. Then, when the reverse bucket 52 moves again to the neutral position, the deflector 51 also maintains the neutral position. In other words, when the reverse bucket 52 moves to the neutral position through the neutral operations, the deflector 51 always moves to the neutral position.

Thus, with the third jet propulsion boat 10B, even when any one of the forward-movement operations and the backward-movement operations are carried out between the neutral operations immediately before (for example, first neutral operations) and the current neutral operations (for example, second neutral operations), the thrust generated immediately after the neutral operations is always the predetermined thrust. Thus, even when any operation is carried out on the third operation element 75 under the state in which the first neutral operations have been carried out, the operator can obtain the same thrust as that obtained at the start time point of the first neutral operations without operating the third operation element 75 at the start time point of the second neutral operations.

As a result, the operator can operate the third operation element 75 while assuming that the turn position of the deflector 51 is the same position each time the operator carries out the neutral operations. Therefore, operability can be increased when the third jet propulsion boat 10B is moved forward at very low speed, is moved backward at very low speed, or is maintained in the boat stop state. That is, the third jet propulsion boat 10B can achieve equivalent effects as those of the first jet propulsion boat 10.

Fourth Embodiment

Description is now made of a water jet propulsion boat (hereinafter also referred to as "fourth jet propulsion boat 10C") according to a fourth embodiment of the present invention. The control device (ECU) of the third jet propulsion boat 10B always moves the position of the deflector 51 to the neutral position (predetermined initial position) when the neutral operations have been carried out. The fourth jet propulsion boat 10C is different from the third jet propulsion boat 10B in that the movement position of the deflector 51 at a time point immediately before any one of the forward-movement operations and the backward-movement operations is stored, and the deflector 51 is moved to the stored movement position when the neutral operations are carried out next. Description is now mainly made of this difference.

(Specific Operation of Fourth Jet Propulsion Boat)

Figure 14:
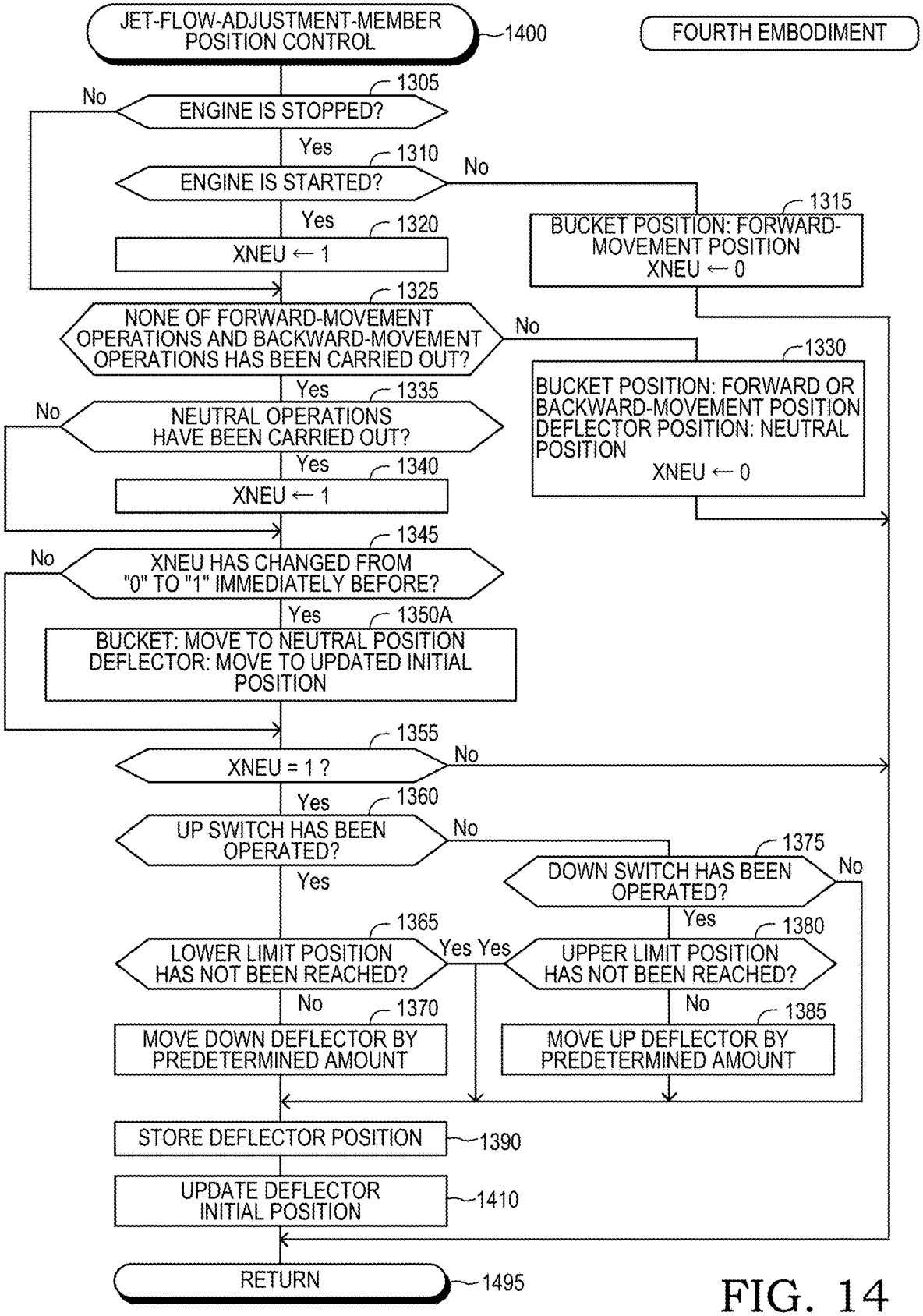
FIG. 14 is a flowchart for illustrating a "jet-flow-adjustment-member position control routine" to be executed by a CPU of an ECU of a water jet propulsion boat according to a fourth embodiment of the present invention.

With reference to FIG. 14, description is made of an actual operation of the fourth jet propulsion boat 10C.

A CPU of the ECU 80 of the fourth jet propulsion boat 10C is configured to execute a jet-flow-adjustment-member-position control routine illustrated by a flowchart of FIG. 14 every time a constant time elapses. The same steps as those referred to in the description of the operation of the third jet propulsion boat 10B are denoted by the same reference symbols.

At Step 1410, the CPU of the fourth jet propulsion boat 10C uses the position of the deflector 51 stored at Step 1390 for the update to a new initial position of the deflector 51. Then, at Step 1350A, which replaces Step 1350 of FIG. 13, the CPU moves the deflector 51 to the initial position of the deflector 51 updated at Step 1410 of the routine executed immediately before.

Thus, with the fourth jet propulsion boat 10C, when any one of the forward-movement operations and the backward-movement operations are carried out under the state in which the neutral operations (first neutral operations) have been carried out, and then new neutral operations (second neutral operations) are carried out, the thrust generated when the second neutral operations are started can be made equal to the thrust that has been generated when the first neutral operations are finished.

Thus, even when any one of the forward-movement operations and the backward-movement operations have been carried out between the neutral operations (between the first neutral operations and the second neutral operations), the operator can obtain the same thrust as that obtained at the end time point of the first neutral operations without operating again the third operation element 75 at the start time point of the second neutral operations. Thus, for example, when the fourth jet propulsion boat 10C is cruising in a river having approximately the same strength of flow, operability can be increased when the fourth jet propulsion boat 10C is maintained in the boat stop state at different locations on the river. That is, the fourth jet propulsion boat 10C can achieve equivalent effects as those of the second jet propulsion boat 10A.

Modification Examples

The present invention is not limited to the embodiments described above, and as described below, various modification examples can be adopted within the scope of the present invention.

In the above-mentioned embodiments, the push button switches are used for the third operation element 75. However, the third operation element 75 is not limited to the push button switches, and the switches are only required to be easily operated by the operator while the operator is gripping the right grip portion 72R or the left grip portion 72L, and may include a dial switch, a slide switch, and a momentary toggle switch. Further, the third operation element 75 is arranged in the vicinity of the left grip portion 72L, but may be arranged in the vicinity of the right grip portion 72R, and inside the right grip portion 72R in the right-and-left direction.

In the above-mentioned embodiments, description has been made of the example in which the turn position of the reverse bucket 52 is moved from the neutral position to the very low-speed forward-movement position at one level and is moved to the very low-speed backward-movement position at one level. However, the very low-speed forward-movement position and the very low-speed backward-movement position may be set at a plurality of levels.

In the first embodiment and the second embodiment, the very low-speed forward movement and the very low-speed backward movement are carried out by changing the turn position of the reverse bucket 52. In the third embodiment and the fourth embodiment, the very low-speed forward movement and the very low-speed backward movement are carried out by changing the turn position of the deflector 51. However, the turn position of the reverse bucket 52 and the turn position of the deflector 51 may simultaneously be changed.

In the above-mentioned embodiments, the potentiometers are used as the position sensors, but the position sensors may be any one of a rotary encoder, a resolver, and a Hall IC, or may include two or more thereof.

What is claimed is:

1. A water jet propulsion boat, comprising:

a boat body having a steering handle, the steering handle having a right grip portion and a left grip portion;

an engine mounted to the boat body;

a jet flow generation device including a jet port, the jet flow generation device being configured to be driven by the engine, and being configured to jet out water from the jet port in a direction backward of the boat body to generate a jet flow, the jet flow generation device being configured to generate the jet flow even when the engine is in an idling state;

a jet flow adjustment member that is movable with respect to the boat body, the jet flow adjustment member being configured to divide the jet flow from the jet port into a forward-movement jet flow having a backward jet flow component directed backward of the boat body, and a backward-movement jet flow having a forward jet flow component directed forward of the boat body, and to adjust a difference between a first thrust generated by the forward jet flow component and a second thrust generated by the backward jet flow component in accordance with a movement position of the jet flow adjustment member;

a first operation element for operating the water jet propulsion boat with a changeable first operation amount, the first operation element being provided in the right grip portion of the steering handle;

a second operation element for operating the water jet propulsion boat with a changeable second operation amount, the second operation element being provided in the left grip portion of the steering handle;

a third operation element for operating the water jet propulsion boat, the third operation element being different from the first operation element and the second operation element; and a control device configured to:

control, when a first mode is selected, an amount of the jet flow and the movement position of the jet flow adjustment member, based on at least one of the first operation amount of the first operation element or the second operation amount of the second operation element; and maintain, when a second mode is selected, an operation state of the engine in the idling state, and control the movement position of the jet flow adjustment member in accordance with an operation on the third operation element.

2. A water jet propulsion boat according to claim 1, wherein the first operation element includes a first lever to be moved by an operator within a first range to change the first operation amount, and wherein the second operation element includes a second lever to be moved by the operator within a second range to change the second operation amount.

3. A water jet propulsion boat according to claim 1, wherein the third operation element is a push button switch.

4. A water jet propulsion boat according to claim 3, wherein the third operation element includes a forward-movement push button and a backward-movement push button, and wherein the control device is configured to:

maintain, when the forward-movement push button of the third operation element is operated in the second mode, the operation state of the engine in the idling state, and change the movement position of the jet flow adjustment member so that the second thrust generated by the backward jet flow component increases and the first thrust generated by the forward jet flow component decreases; and maintain, when the backward-movement push button of the third operation element is operated in the second mode, the operation state of the engine in the idling state, and change the movement position of the jet flow adjustment member so that the second thrust generated by the backward jet flow component decreases and the first thrust generated by the forward jet flow component increases.

5. A water jet propulsion boat according to claim 1, wherein the jet flow adjustment member includes a reverse bucket turnably arranged about a horizontal axis of the boat body, and being configured to adjust the forward jet flow component and the backward jet flow component in accordance with the movement position.

6. A water jet propulsion boat according to claim 1, wherein the jet flow adjustment member includes:

a deflector having a discharge port, and being configured to change an up-and-down direction of the jet flow jetted out from the jet port; and a reverse bucket configured to divide the jet flow jetted out from the discharge port of the deflector, into the forward-movement jet flow and the backward-movement jet flow, and wherein the control device is configured to cause, when the third operation element is operated in the second mode, the deflector to change a direction of the jet flow jetted out from the jet port from an up-and-down direction to a direction for adjusting a difference between the first thrust generated by the forward jet flow component and the second thrust generated by the backward jet flow component.

7. A water jet propulsion boat according to claim 1, wherein the control device is configured to:

store, when the second mode is switched to the first mode, the movement position of the jet flow adjustment member at a time point immediately before the second mode is switched to the first mode as a stored movement position; and set, when the first mode is switched to the second mode, the movement position of the jet flow adjustment member to the stored movement position.

8. A water jet propulsion boat according to claim 1, wherein the control device is configured to always set the movement position of the jet flow adjustment member to a predetermined movement position when the second mode is selected.

9. A water jet propulsion boat according to claim 1, wherein the control device is configured to:

change the movement position of the jet flow adjustment member so that the difference becomes a first value smaller than 0 when a forward-movement operation for causing the boat body to move forward is carried out on the first operation element and the second operation element, and the difference becomes a second value larger than 0 when a backward-movement operation for causing the boat body to move backward is carried out on the first operation element and the second operation element, and adjust a flow rate of the jet flow jetted out from the jet port by changing output of the engine based on at least one of the operation amount of the first operation element or the operation amount of the second operation element;

change the movement position of the jet flow adjustment member so that the difference becomes a third value larger than the first value and smaller than the second value, and maintain the operation state of the engine in the idling state independently of the operation amount of the first operator and the operation amount of the second operator when a neutral operation of maintaining the boat body in a boat stop state is carried out on the first operation element and the second operation element; and maintain the operation state of the engine in the idling state, and change the movement position of the jet flow adjustment member so that the difference changes within a range equal to or larger than the first value and equal to or smaller than the second value when the third operation element is operated in the second mode.

10. A water jet propulsion boat according to claim 6, wherein the deflector is disposed at an initial position in an initial state at a rear side of the jet port and being turnably arranged at least about a horizontal axis of the boat body, and wherein the control device is configured to:

set, when a forward-movement operation for causing the boat body to move forward is carried out on the first operation element and the second operation element, a turn position of the deflector about the horizontal axis to the initial position, and set a turn position of the reverse bucket to a first position at which the forward jet flow component is inhibited from being generated and the backward jet flow component is generated from a jet flow jetted out from the discharge port of the deflector;

set, when a backward-movement operation for causing the boat body to move backward is carried out on the first operation element and the second operation element, the turn position of the deflector about the horizontal axis to the initial position, and set the turn position of the reverse bucket to a second position at which at least the forward jet flow component is generated from the jet flow jetted out from the discharge port of the deflector; and set, when a neutral operation of maintaining the boat body in a boat stop state is carried out on the first operation element and the second operation element, the turn position of the deflector about the horizontal axis to the initial position, and set the turn position of the reverse bucket to a third position at which at least the forward jet flow component and the backward jet flow component are generated from the jet flow jetted out from the discharge port of the deflector.

11. A water jet propulsion boat according to claim 1, wherein the control device is configured to:

select the first mode when a first operation is carried out on the first operation element or the second operation element; and select the second mode when a second operation is carried out on the first operation element or the second operation element.

12. A water jet propulsion boat according to claim 2, wherein the jet flow adjustment member includes a reverse bucket turnably arranged about a horizontal axis of the boat body, and being configured to adjust the forward jet flow component and the backward jet flow component in accordance with the movement position.

13. A water jet propulsion boat according to claim 3, wherein the jet flow adjustment member includes a reverse bucket turnably arranged about a horizontal axis of the boat body, and being configured to adjust the forward jet flow component and the backward jet flow component in accordance with the movement position.

14. A water jet propulsion boat according to claim 4, wherein the jet flow adjustment member includes a reverse bucket turnably arranged about a horizontal axis of the boat body, and being configured to adjust the forward jet flow component and the backward jet flow component in accordance with the movement position.

15. A water jet propulsion boat according to claim 2, wherein the jet flow adjustment member includes:

a deflector having a discharge port, and being configured to change an up-and-down direction of the jet flow jetted out from the jet port; and a reverse bucket configured to divide the jet flow jetted out from the discharge port of the deflector, into the forward-movement jet flow and the backward-movement jet flow, and wherein the control device is configured to cause, when the third operation element is operated in the second mode, the deflector to change a direction of the jet flow jetted out from the jet port from an up-and-down direction to a direction for adjusting a difference between the first thrust generated by the forward jet flow component and the second thrust generated by the backward jet flow component.

16. A water jet propulsion boat according to claim 3, wherein the jet flow adjustment member includes:

a deflector having a discharge port, and being configured to change an up-and-down direction of the jet flow jetted out from the jet port; and a reverse bucket configured to divide the jet flow jetted out from the discharge port of the deflector, into the forward-movement jet flow and the backward-movement jet flow, and wherein the control device is configured to cause, when the third operation element is operated in the second mode, the deflector to change a direction of the jet flow jetted out from the jet port from an up-and-down direction to a direction for adjusting a difference between the first thrust generated by the forward jet flow component and the second thrust generated by the backward jet flow component.

17. A water jet propulsion boat according to claim 2, wherein the control device is configured to:

store, when the second mode is switched to the first mode, the movement position of the jet flow adjustment member at a time point immediately before the second mode is switched to the first mode as a stored movement position; and set, when the first mode is switched to the second mode, the movement position of the jet flow adjustment member to the stored movement position.

18. A water jet propulsion boat according to claim 3, wherein the control device is configured to:

store, when the second mode is switched to the first mode, the movement position of the jet flow adjustment member at a time point immediately before the second mode is switched to the first mode as a stored movement position; and set, when the first mode is switched to the second mode, the movement position of the jet flow adjustment member to the stored movement position.

19. A water jet propulsion boat according to claim 2, wherein the control device is configured to always set the movement position of the jet flow adjustment member to a predetermined movement position when the second mode is selected.

20. A water jet propulsion boat according to claim 3, wherein the control device is configured to always set the movement position of the jet flow adjustment member to a predetermined movement position when the second mode is selected.

* * * * *